United States Patent [19]

Kitaguchi et al.

[11] Patent Number: 4,678,739

[45] Date of Patent: Jul. 7, 1987

[54] IMAGE FORMING METHOD INCLUDING HEATING STEP

[75] Inventors: Hiroshi Kitaguchi; Masashi Takeuchi; Kozo Sato; Masaaki Tsukase; Masatoshi Kato, all of Kanagawa, Japan

[73] Assignee: Fuji Photo Film Co., Ltd., Kanagawa, Japan

[21] Appl. No.: 810,149

[22] Filed: Dec. 18, 1985

[30] Foreign Application Priority Data

Dec. 20, 1984 [JP] Japan ..... 59-268925

[51] Int. Cl.[4] ..... G03C 5/54; G03C 1/34; G03C 5/26

[52] U.S. Cl. ..... 430/353; 430/203; 430/219; 430/351; 430/611; 430/617; 430/619; 430/955; 430/957; 430/959

[58] Field of Search ..... 430/218, 219, 611, 955, 430/957, 619, 203, 617, 351, 353, 959

[56] References Cited

U.S. PATENT DOCUMENTS 4,416,977 11/1983 Ohashi et al. ..... 430/955
4,420,554 12/1983 Ohashi et al. ..... 430/955
4,503,139 3/1985 Bartels-Keith et al. ..... 430/955

*Primary Examiner*—Richard L. Schilling
*Attorney, Agent, or Firm*—Sughrue, Mion, Zinn, Macpeak & Seas

[57] ABSTRACT

A method for forming an image which has a step of heating an image-forming material in the presence of a compound represented by formula (I), whereby unevenness of image density and increase in fog due to fluctuation of development temperature, which have so far been caused in heat-developable photosensitive materials, can be prevented from occurring:

(I)

wherein R represents a hydrogen atom, or a group selected from a class consisting of groups represented by formulae (A) to (C)

(A)

(B)

(C)

wherein $R^{11}$ and $R^{12}$ each represents a substituted or unsubstituted alkyl group, a cycloalkyl group, a substituted or unsubstituted alkenyl group, an aralkyl group, a substituted or unsubstituted aryl group, a heterocyclic group, an alkyloxy group, an aryloxy group, an alkylthio group, an arylthio group, or a substituted or unsubstituted amino group, or $R^{11}$ and $R^{12}$ combine with each other to form a 5- or 6-membered ring;

Q represents a hydrogen atom, an alkyl group, or an aryl group; TIME represents a timing group; PUG represents a photographically useful agent moiety; n represents 0 or an integer; and Z represents atoms forming a benzene ring.

16 Claims, No Drawings

IMAGE FORMING METHOD INCLUDING HEATING STEP

FIELD OF THE INVENTION

The present invention relates to an image forming method comprising a heating step, and, more particularly, to a method for forming an image in which a step of heating in the presence of a precursor of a photographically useful agent is included.

BACKGROUND OF THE INVENTION

Silver halide-using photography is superior in photographic characteristics, e.g., photographic speed, facility of gradient control, etc., to other photographic techniques, such as electrophotography, diazo photography, and so on. Therefore, it has so far been employed most prevailingly. In recent years, techniques have been developed which enable simple and rapid formation of images by changing the image-forming processing in the silver halide-using photography from the conventional wet process using a developing solution or the like to a dry process using a heat-applying means or the like.

Heat-developable photosensitive materials are well-known in the photographic art, and such materials and the processes therefor are described, e.g., in *Shashin Kogaku no Kiso* (Fundamentals of Photographic Engineering), pp. 553–555, Corona Co. (1979); *Eizo Joho* (Information on Images), p. 40 (April 1978); Neblette's Handbook of Photography and Reprography, 7th Ed., pp. 32–33, Van Nostrand Reinhold Company; U.S. Pat. Nos. 3,152,904, 3,301,678, 3,392,020, and 3,457,075; British Pat. Nos. 1,131,108 and 1,167,777; and *Research Disclosure,* RD No. 17029, pp. 9–15 (June 1978).

Many methods for obtaining color images have been proposed. For instance, as for the method of forming color images by binding couplers to oxidation products of developing agents, there are proposed the combinations of p-phenylenediamine type reducing agents with phenolic or active methylene-containing couplers in U.S. Pat. No. 3,531,286, the reducing agents of p-aminophenol type in U.S. Pat. No. 3,761,270, the reducing agents of sulfonamidophenol type in Belgian Pat. No. 802,519 and *Research Disclosure,* Vol. 137, pp. 31–32 (Sept. 1975), and the combinations of sulfonamidophenol type reducing agents with 4-equivalent couplers in U.S. Pat. No. 4,021,240.

In addition, as for the method of forming positive color images using the light-sensitive silver dye bleach process, useful dyes and bleaching methods are described in, e.g., *Research Disclosure,* RD No. 14433, pp. 30–32 (April 1976), ibid., RD No. 15227, pp. 14–15 (Dec. 1976), and U.S. Pat. No. 4,235,957.

Moreover, the method of forming images by heat development, in which compounds having a dye moiety in advance and capable of releasing a mobile dye under a high temperature condition in correspondence or counter-correspondence to the reaction of reducing silver halide to silver are utilized, is disclosed in published unexamined European Patent Application Nos. 76,492 and 79,056, and Japanese Patent Application (OPI) Nos. 28928/83 and 26008/83 (the term "OPI" as used herein refers to a "published unexamined Japanese patent application").

These heat-developable photosensitive materials are characterized by the development-processing to which they are to be subjected. The development-processing is carried out under heating in a condition that water is substantially absent from the developing system. Such dry processing has a great advantage in that it can provide images simply and rapidly.

On the other hand, the heat-developable photosensitive materials necessitate therein the prior incorporation of all photographic agents necessary to effect development because they cannot expect a supply of desired photographic agents from a developing solution or the like. However, if a photographic agent is added to a photosensitive material in an active form, it tends to undergo reactions with other components present in the photosensitive material or decomposes under the influence of heat or oxygen during storage prior to processing. Therefore, it becomes impossible to fully achieve the expected capabilities at the time of processing.

One solution to this problem is a method in which a photographic agent is converted into a substantially inactive form by blocking the active group, that is, a precursor thereof, and then, the precursor is added to a photosensitive material.

When the useful photographic agent is a dye, a functional group having a great effect on spectral absorption of the dye is blocked and thereby, its spectral absorption is shifted to the shorter or the longer wavelength side. Under this circumstance, even if the blocked dye is also present in a silver halide emulsion layer with a spectral sensitivity in the wavelength region corresponding to the spectral absorption of the original dye, a lowering of sensitivity due to the so-called filter effect does not occur. Therefore, it can be used advantageously.

When the photographically useful agent is an antifoggant or a development inhibitor, blocking of the active group can offer many advantages, e.g., desensitization due to adsorption onto light-sensitive silver halide grains and formation of silver salts upon storage can be inhibited, and at the same time, through timely release of such photographic agents, fog can be reduced without impairing photographic speed, fog arising from over development can be depressed, development can be stopped at a desired time, and so on. When the photographically useful agent is a developer, assistant developer, or a fogging agent, blocking the active group or the adsorptive group can offer the advantages that various photographically adverse effects due to conversion of the developer into semiquinones or oxidants through air oxidation upon storage can be prevented, and/or injection of electrons into silver halide can be prevented from occurring during storage. Thereby, generation of fog nuclei can be inhibited. This results in the realization of stable processing and the like. Where the photographically useful agent is a bleach accelerator or a bleach-fix accelerator, blocking the active group can offer the advantages that in storing the sensitive material, reactions with other components also present with such an agent can be suppressed, while in processing it, the expected ability can be brought into full play upon removal of the blocking group at the time needed.

Several techniques for blocking photographic agents which are usable in conventional photographic materials are already known. For example, well-known techniques involve utilization of a blocking group such as an acyl group, a sulfonyl group or the like, as described in Japanese Patent Publication No. 44805/72, utilization of a blocking group which releases a photographic agent due to the so-called reverse Michel's reaction, as described in Japanese Patent Publication Nos. 17369/79, 9696/80, and 34927/80, utilization of a blocking group which releases a photographic agent by an intramolecular electron transfer accompanying the production of quinonemethide or analogues thereof, as described in Japanese Patent Publication No. 39727/79 and Japanese Patent Application (OPI) Nos. 135944/82, 135945/82, and 136640/82, utilization of the intramolecular ring-closure reaction described in Japanese Patent Application (OPI) No. 53330/80, utilization of the cleavage of a 5- or 6-membered ring described in Japanese Patent Application (OPI) Nos. 76541/82, 135949/82, and 179842/82, and so on. However, all of these known techniques utilize hydrolysis or dehydrogenation due to attack of $OH^{\ominus}$ at the time of wet development, and no precursor techniques applicable to dry processing in which organic bases are used has been known.

SUMMARY OF THE INVENTION

Therefore, a first object of the present invention is to provide a technique for converting photographically useful agents to precursors thereof which can be employed in an image-forming method which includes a heating step.

A second object of the present invention is to provide a compound which is stable at ordinary temperature, and has such a function of releasing one or more photographically useful agents only when it is submitted to heat development.

A third object of the present invention is to provide an image-forming method having a heating step, which is resistant to unevenness in image quality even when subjected to fluctuations in development temperature.

The above-described objects of the present invention are attained by an image-forming method which has a step of heating in the presence of a compound represented by formula (I)

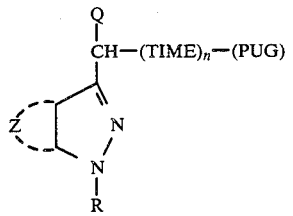

(I)

In formula (I), R represents a hydrogen atom or a group selected from a class consisting of those represented by formulae (A) to (C)

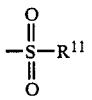

(A)

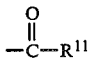

(B)

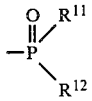

(C)

wherein $R^{11}$ and $R^{12}$ (which of course may be the same or different) each represents a substituted or unsubstituted alkyl group, a cycloalkyl group, a substituted or unsubstituted alkenyl group, an aralkyl group, a substituted or unsubstituted aryl group, a heterocyclic group, an alkyloxy group, an aryloxy group, an alkylthio group, an arylthio group, or a substituted or unsubstituted amino group, or $R^{11}$ and $R^{12}$ combine with each other to form a 5- or 6-membered ring;

Q represents a hydrogen atom, an alkyl group, or an aryl group; TIME represents a timing group; PUG represents a photographically useful agent moiety; n represents 0 or an integer; and Z represents atoms forming a benzene ring.

DETAILED DESCRIPTION OF THE INVENTION

A benzene ring formed by atoms represented by Z in formula (I) may have from 1 to 4 substituent groups. Suitable examples of such substituent groups include substituted and unsubstituted alkyl groups, substituted and unsubstituted alkenyl groups, substituted and unsubstituted alkoxy groups, substituted and unsubstituted aryl groups, halogen atoms, acylamino groups, cyano group, nitro group, alkylthio groups, arylthio groups, alkylsulfonyl groups, arylsulfonyl groups, sulfonylamino groups, substituted and unsubstituted carbamoyl groups, substituted and unsubstituted sulfamoyl groups, disubstituted amino groups which are substituted with alkyl or aryl groups, carboxy group, sulfo group, alkyloxycarbonyl groups, and aryloxycarbonyl groups.

Alkyl groups represented by the substituents $R^{11}$ and $R^{12}$ are preferably those which have a straight or branched chain alkyl groups containing from 1 to 18 carbon atoms, with specific examples including a methyl group, ethyl group, n-propyl group, n-butyl group, n-hexyl group, n-heptyl group, 2-ethylhexyl group, n-decyl group, n-decyl group, and the like. Suitable examples of substituent groups with which alkyl groups may be substituted include halogen atoms, alkoxy groups, aryloxy groups, cyano group, alkylthio groups, arylthio groups, substituted and unsubstituted carbamoyl groups, alkylsulfonyl groups, arylsulfonyl groups, disubstituted amino groups which are substituted with alkyl or aryl groups, hydroxy group, carboxy group, sulfo group, acylamino groups, sulfonylamino groups, and so on.

Cycloalkyl groups represented by $R^{11}$ and $R^{12}$ are preferably 5- or 6-membered groups containing from 5 to 10 carbon atoms, with specific examples including cyclopentyl, cyclohexyl, and the like.

Alkenyl groups represented by $R^{11}$ and $R^{12}$ include vinyl group, allyl group, crotyl group, substituted and unsubstituted styryl groups, and so on.

Aralkyl groups represented by $R^{11}$ and $R^{12}$ include benzyl group, $\beta$-phenetyl group, and so on.

Aryl groups represented by $R^{11}$ and $R^{12}$ are preferably those containing from 6 to 18 carbon atoms, with specific examples including a phenyl group, naphthyl group, anthryl group, and the like. Preferred examples of substituent groups with which such aryl groups may be substituted include substituted and unsubstituted alkyl group, substituted and unsubstituted alkoxy group, substituted and unsubstituted aryl groups, halogen atoms, acylamino groups, sulfonylamino groups, cyano groups, nitro groups, alkylthio groups, arylthio groups, alkylsulfonyl groups, arylsulfonyl groups, carbonyloxy groups, hydroxy groups, substituted and unsubstituted carbamoyl groups, substituted and unsubstituted sulfamoyl groups, disubstituted amino groups which are substituted with alkyl or aryl groups, carboxy group, sulfo group, alkyloxycarbonyl groups, aryloxycarbonyl groups, and so on.

Heterocyclic groups represented by $R^{11}$ and $R^{12}$ are preferably 5- or 6-membered heterocyclic ring containing oxygen, nitrogen, or sulfur as a hetero atom, with specific examples including pyridyl, furyl, thienyl, pyrrolyl, indolyl, and so on. These heterocyclic groups may each be substituted with the groups set forth as examples of substituent groups which may be present on the above-described aryl groups.

Preferred alkoxy or aryloxy groups, and alkylthio or arylthio groups, are represented by formulae (D) and (E), respectively.

$$-OR^{13} \quad (D)$$

$$-SR^{14} \quad (E)$$

Examples suitable for $R^{13}$ and $R^{14}$ include the same alkyl and aryl groups as described for $R^{11}$ and $R^{12}$. In addition, $R^{13}$ and $R^{14}$ may have proper substituent groups.

Q in formula (I) represents a hydrogen atom, an alkyl group, or an aryl group. Examples of alkyl and aryl groups represented by Q include the same groups as set forth above in the description of $R^{11}$ and $R^{12}$.

TIME in formula (I) represents a so-called timing group. Typical examples thereof in a conjugated form with (PUG) group $$-OC(=O)-(PUG)$$

group as described in Japanese Patent Publication No. 9696/80, Japanese Patent Application (OPI) Nos. 1139/83 and 1140/83, and so on, and $-OCH_2-(PUG)$ group described in Japanese Patent Application (OPI) No. 93442/84.

Examples of photographically useful agents (PUG) released from precursor compounds include antifoggants, development inhibitors, developing agents, development accelerators, electron donors (ED compounds), fogging agents, nucleating agents, silver halide solvents, bleach accelerators, bleach-fix accelerators, fixing accelerators, dyes, color materials for the color diffusion transfer process, a coupler, and so on. Specific examples of antifoggants and development inhibitors include nitrogen-containing heterocyclic compounds which have a mercapto group. Specific examples of developing agents and development accelerators include hydroquinones, catechols, aminophenols, p-phenylenediamines, pyrazolidones, ascorbic acids, and so on. Specific examples of electron donors, fogging agents, and nucleating agents include α-hydroxyketones, α-sulfonamidoketones, hydrazines, hydrazides, tetrazolium salts, aldehydes, acetylenes, quaternary salts, imides, and so on. Specific examples of silver halide solvents include thioethers, rhodanines, hypo, methylenebissulfones, and so on. Specific examples of bleach accelerators and bleach-fix accelerators include aminoethanethiols, sulfoethanethiols, aminoethanethiocarbamates, and so on. A specific example of fixing accelerators is hypo. Specific examples of dyes including azo dyes, azomethine dyes, anthraquinone dyes, indophenol dyes, and so on.

In the image-forming method of the present invention in which a heating step is included, techniques which have been developed for so-called heat-developable photosensitive materials (e.g., those described in the foregoing texts and patent specifications) are employed to advantage. Specifically, the compound represented by formula (I) may be incorporated in any constituent layer of a heat-developable photosensitive material which is present on a support (e.g., photosensitive layer, an interlayer, or a protective layer), while when an image-receiving layer is provided on a separate support, it may be incorporated in any layer provided on (or over) this support.

Heat-developable photosensitive materials in which silver halides are employed as photosenstive substance are preferred.

Temperatures ranging from about 80° C. to about 250° C. are generally suitable for heating, and those ranging from 110° C. to 180° C. are particularly useful therefor.

Of the above-described photographically useful agents, those which can exhibit a particularly noteworthy effect when —(PUG) blocked in the form represented by formula (I) are development inhibitors. In particular, inhibitors capable of producing great effects are represented by formula (II):

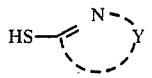

(II)

wherein Y represents atoms forming a 5- or 6-membered heterocyclic ring (preferably one which contains a sulfur atom, another nitrogen atom, or an oxygen atom in the ring in addition to the nitrogen atom). In formula (I), the blocking group binds to the site of the sulfur atom or the nitrogen atom.

Examples of development inhibitors represented by formula (II) include the compounds

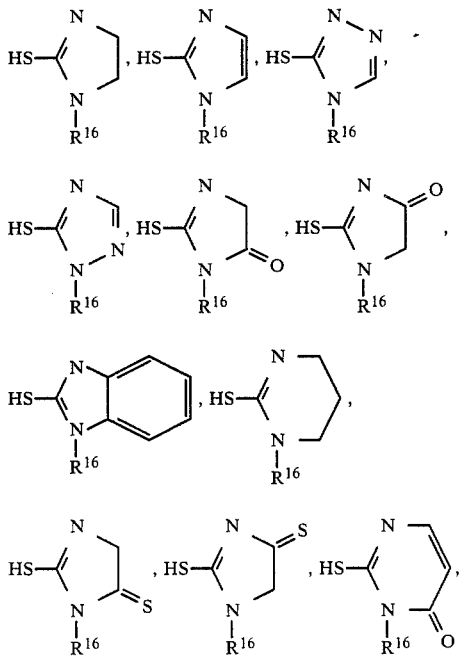

-continued

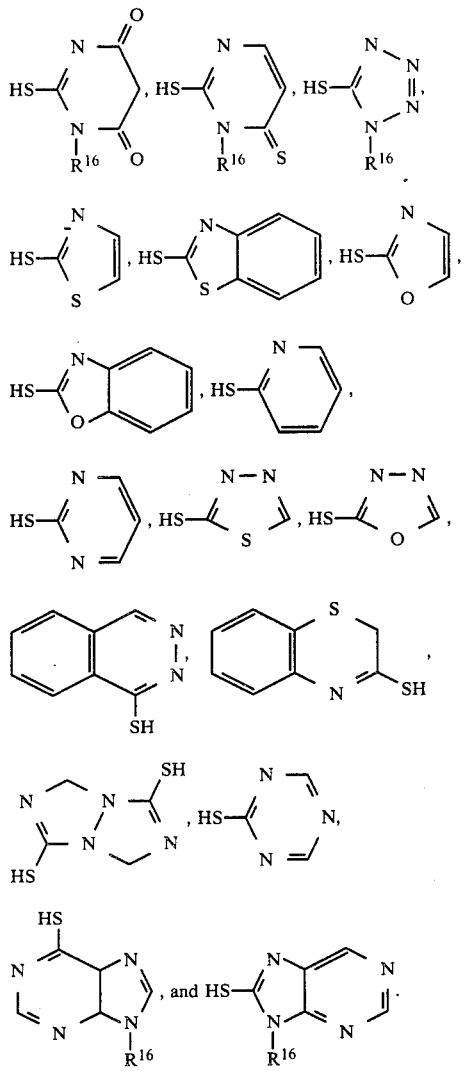

In the foregoing structural formulae, $R^{16}$ represents a hydrogen atom, an alkyl group, an aryl group, a cyclo-alkyl group, an alkenyl group, or an aralkyl group, each of which has preferably 20 or less of carbon atoms and may have an appropriate substitutent group. Typical examples of such a substituent group include those allowed for $R^{11}$. Carbon atoms which form the ring structures illustrated above may be substituted. Typical examples thereof include substituent groups allowed for a benzene ring or a naphthalene ring present in formula (I).

Nitrogen-containing heterocyclic compounds which have a mercapto group, which are represented by formula (II), are known to have a development inhibiting effect in silver halide photosensitive materials. However, if the compound represented by formula (II) is added to an emulsion layer from the first, development is inhibited at the early stage of development, whereby the image density obtained is lowered and the photographic speed is decreased. On the other hand, the compounds of the present invention, which are represented by formula (I), gradually release the development inhibitors represented by formula (II) upon heat development. Therefore, it is feasible to stop the development without lowering the image density.

Moreover, prior incorporation of the compound (I) of the present invention, in which the development inhibitor of formula (II) is blocked, in heat-developable photosensitive materials enables the materials to acquire an ability of compensating for non-uniformity of development temperature. Actually, subtle non-uniformity of development temperature is unavoidable, because development is generally carried out under high temperatures of 100° C. or above. Image density attained is higher in areas heated at higher temperatures, while it is lower in areas heated at lower temperatures. Therefore, unevenness is caused in image density as a whole, particularly in fog density of the non-image areas. However, if the compound (I) of the present invention is incorporated in a heat-developable photosensitive material, attainable image density in higher temperature areas is depressed more because the development inhibitor (II) is released in a larger amount therein. This contributes to success in reduction of unevenness of the image density as a whole.

It is thought that the compound (I) of the present invention produces an indazole anion (III) at the time of heat development, and then releases PUG (or its dissociated product) through electron transfer, as illustrated below:

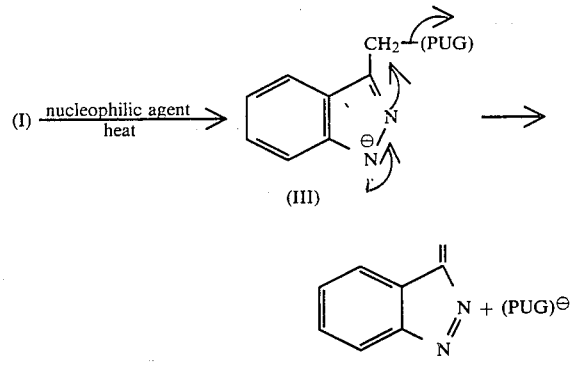

In general, some nucleophilic agent or base is required for conversion of the compound (I) into the indazole anion (III). Although the details are not clear, it is believed that there are, for example, various kinds of terminal residues of amino acids (including $—NH_2$, —OH, $—CO_2H$, —SH, $—N{=}C(NH_2)_2$ and so on) which are constituent elements of gelatin employed as binder. The reaction of these terminal residues with the compound (I) proceeds very slowly at ordinary room temperature (about 20° C.), but it is supposed that the reaction can be accelerated by the high temperature treatment to be conducted in the heat developable photosensitive material to such an extent that the release of PUG may become feasible.

In another case, where some base or its precursor is incorporated as development accelerator in a heat-developable photosensitive material, the base functions as a nucleating agent upon heat development to accelerate the release of PUG. Accordingly, combined use of the compound (I) of the present invention and a base or its precursor is particularly advantageous.

Although it can be presumed that the reaction of the compound represented by formula (I) according to the present invention with nucleophilic reagents occurs in solution, the finding that the same reaction occurs effectively in a dried film also in a short time upon heat development was unforeseen.

The compounds of the present invention have remarkable effects in heat-developable photosensitive materials and further, they can give beneficial effects to conventional photographic systems utilizing an aqueous alkaline solution.

Specific examples of the compounds of the present invention are illustrated below. However, the present invention should not be construed as being limited to the following examples.

(1)

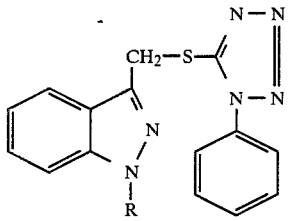

wherein —R represents —$COCH_3$.

(2) A compound containing

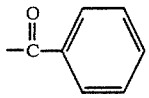

as —R in Compound (1).

(3) A compound containing —H as —R in Compound (1).

(4)

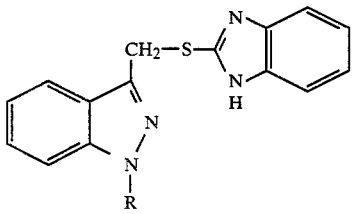

wherein —R represents —$COCH_3$.

(5) A compound containing —H as —R in Compound (4).

(6)

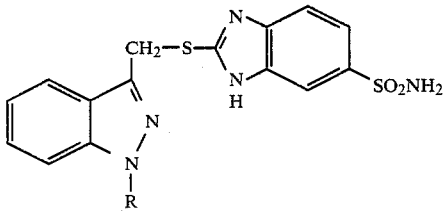

wherein —R represents —$COCH_3$.

(7) A compound containing

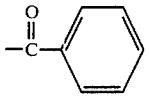

as —R in Compound (6).

(8) A compound containing —H as —R in Compound (6).

(9)

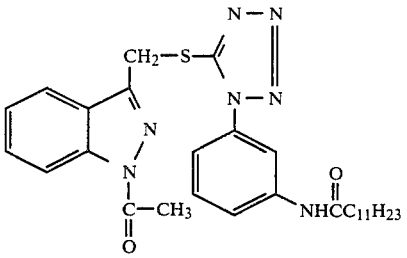

(10)

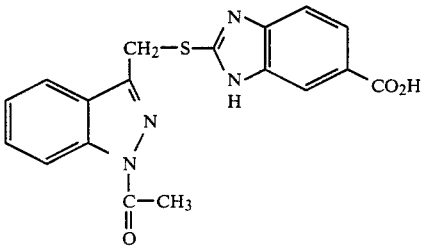

(11)

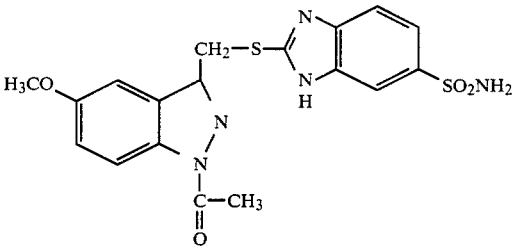

(12)

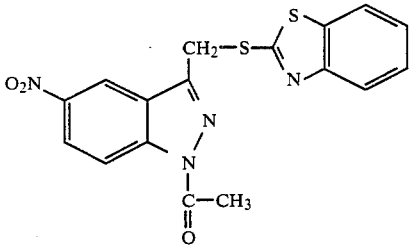

(13)

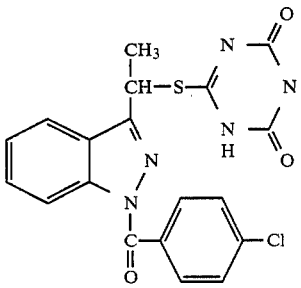

-continued
(14)
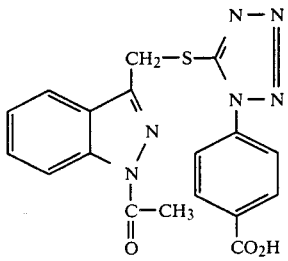
(15)
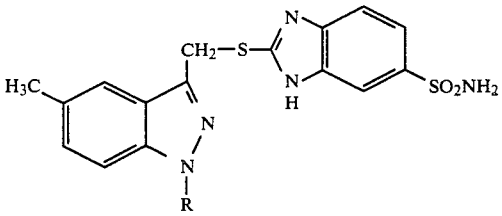
wherein —R represents
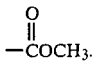
(16) Compound containing —H as —R in Compound (15).
(17)
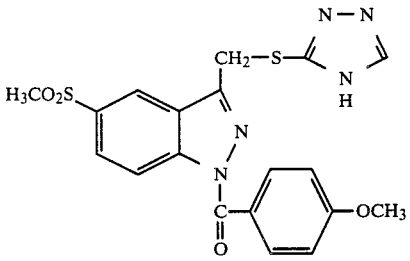
(18)
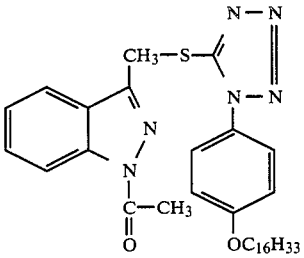
(19)
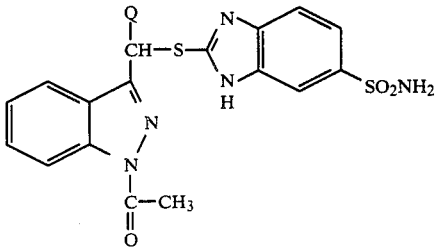
wherein —Q represents —$CH_3$.
(20) Compound containing
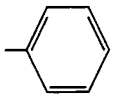
as —Q in Compound (19).
(21)
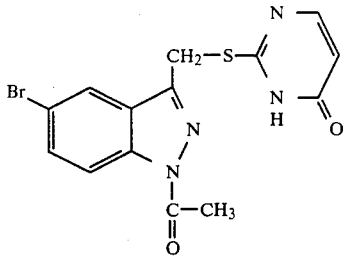
(22)
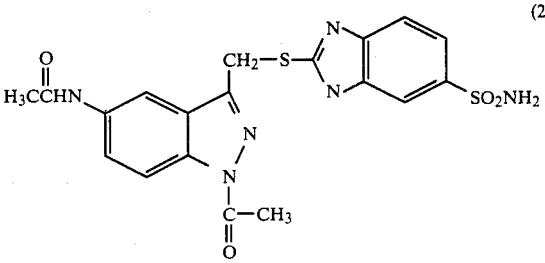
(23)
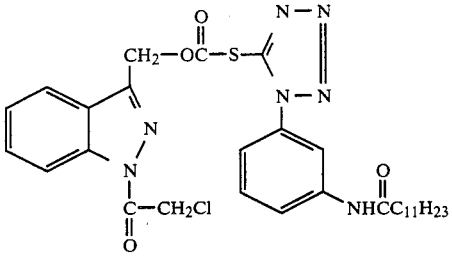
(24)
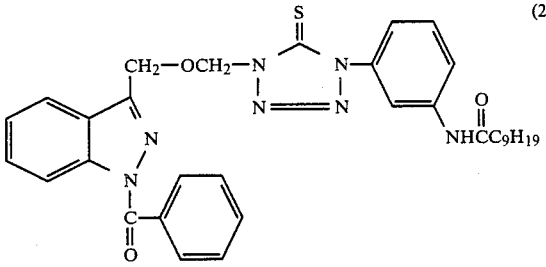
(25)
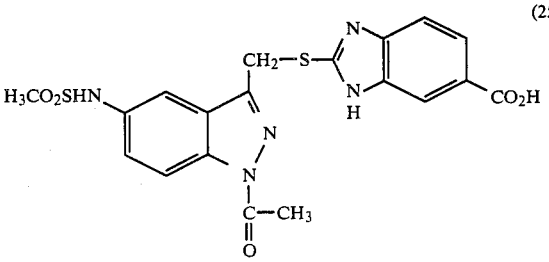

-continued
(26)
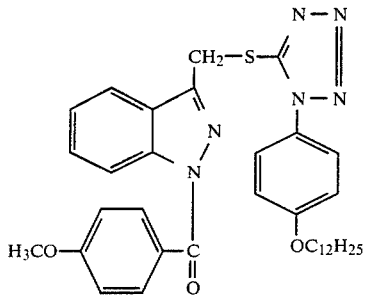
(27)
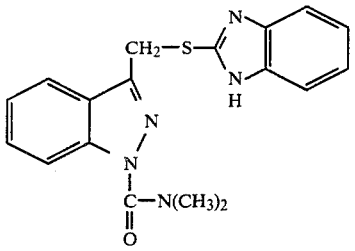
(28)
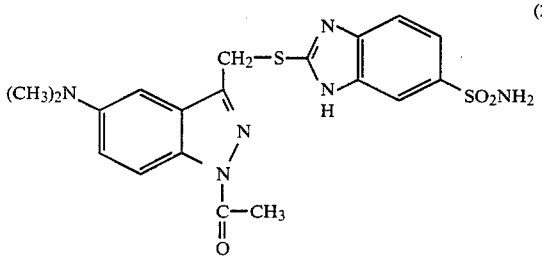
(29)
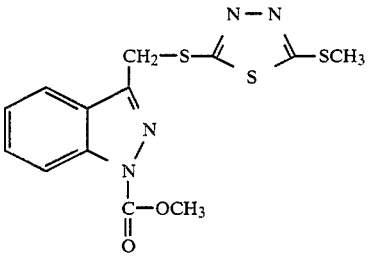
(30)
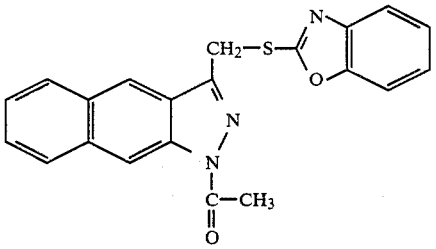
(31)
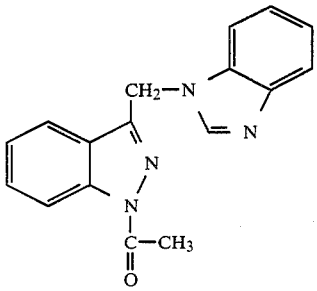
-continued
(32)
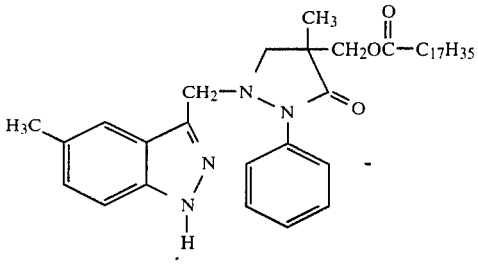
(33)
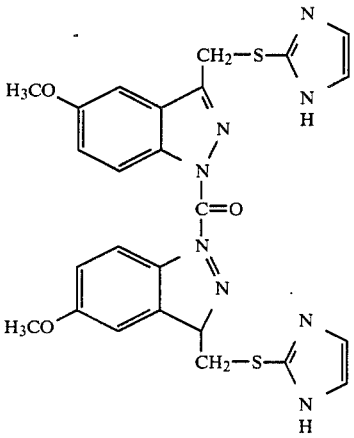
(34)
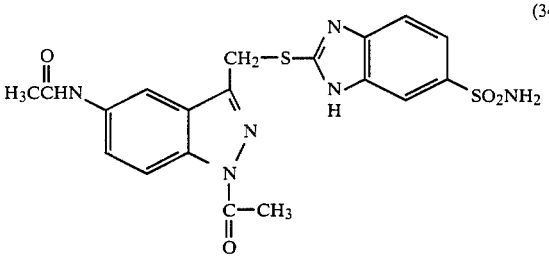
(35)
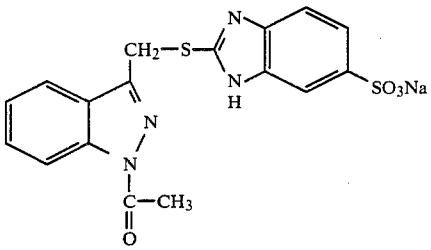
(36)
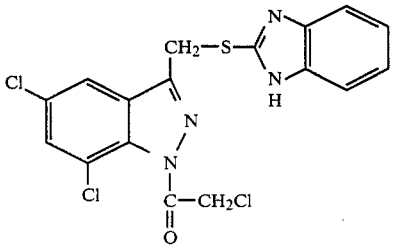

-continued
(37)
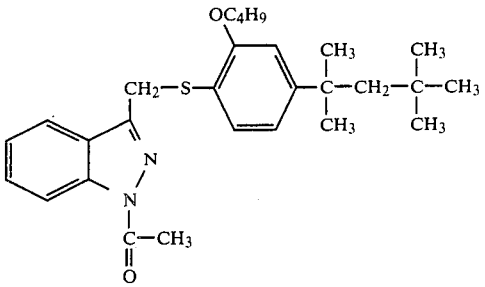
(38)
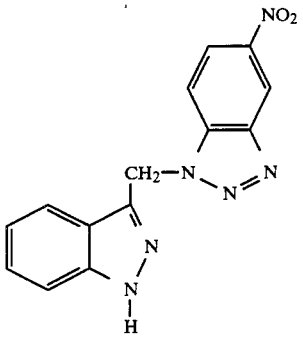
(39)
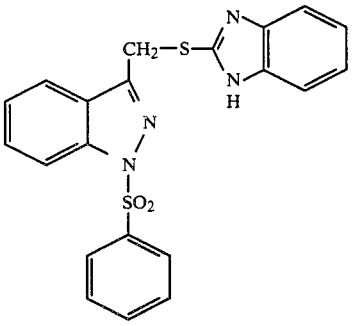
(40)
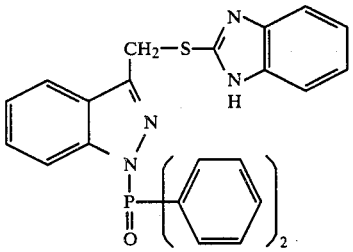
(41)
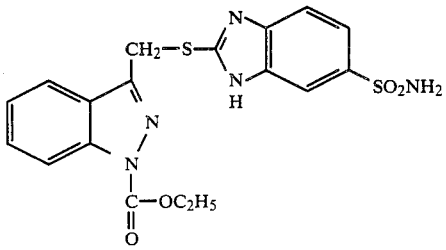
-continued
(42)
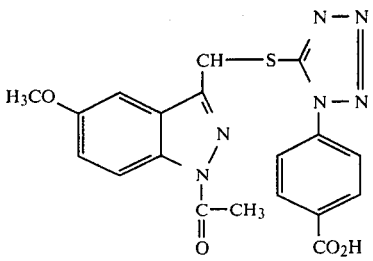
(43)
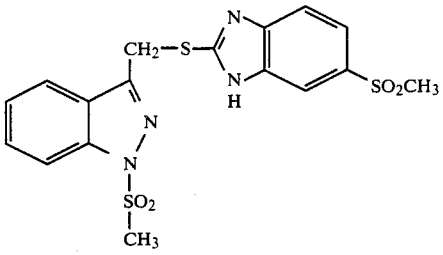
(44)
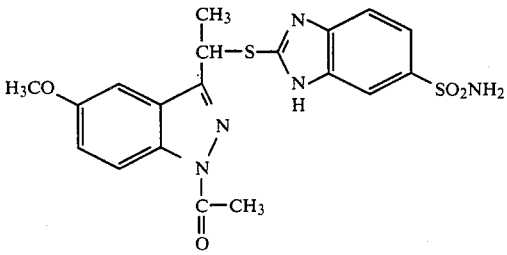
(45)
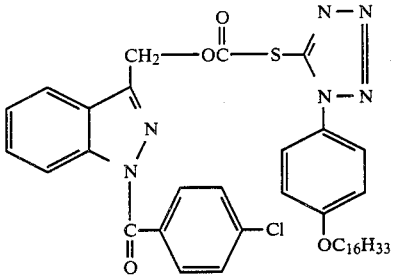
(46)
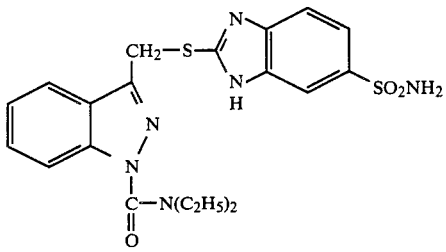
(47)
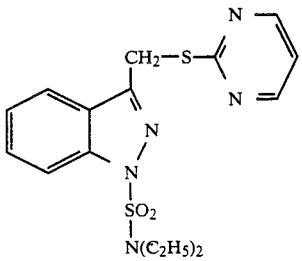

-continued (48)

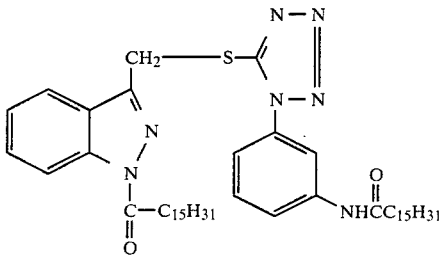

(49)

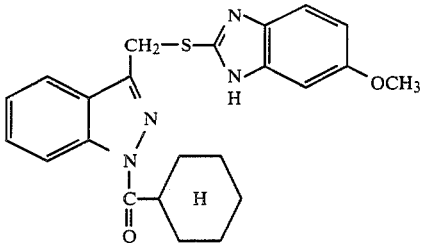

(50)

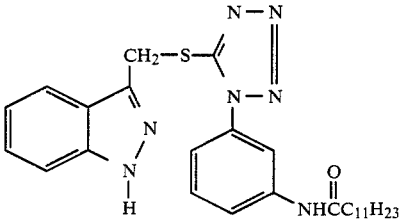

(51)

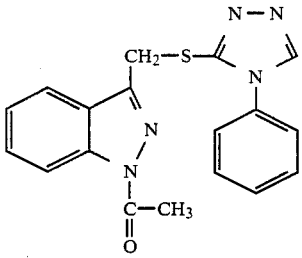

(52)

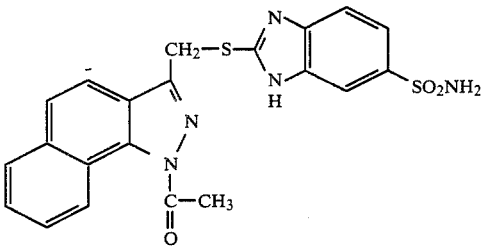

(53)

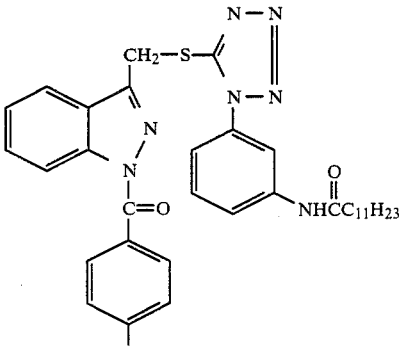

-continued

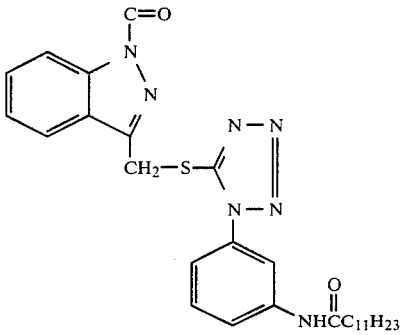

(54)

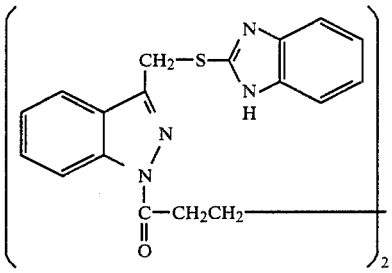

(55)

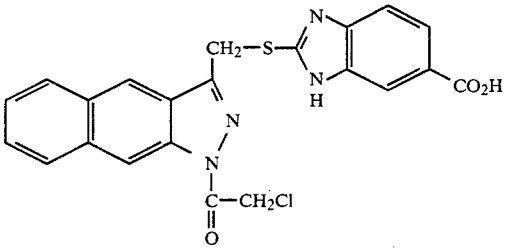

(56)

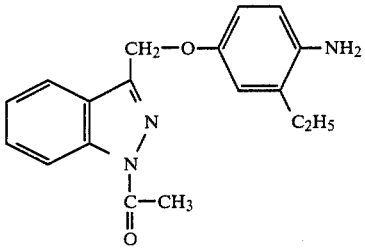

Methods for synthesizing the compounds of the present invention are illustrated in more detail below.

The compound of the present invention in which Q and n in formula (I) are a hydrogen atom and zero, respectively, can be synthesized using 3-methylindazole (or a substituted compound thereof) as a starting material and taking the synthesis route

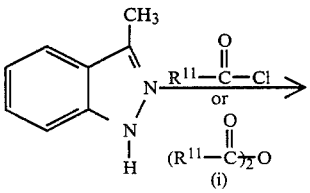

(i)

-continued

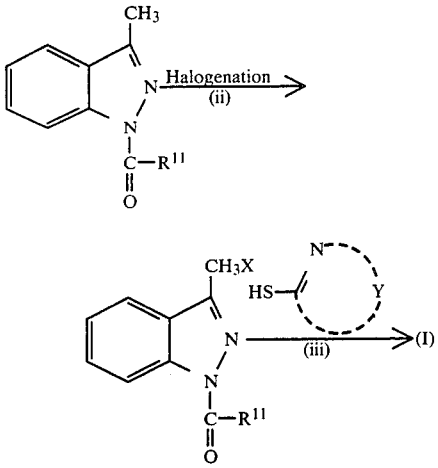

wherein X represents a halogen atom.

When $R^{11}SO_2Cl$ or

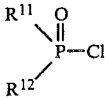

is used in place of $R^{11}COCl$ in the foregoing process (i), the compound containing the moiety of formula (A) to (C), respectively, as the substituent R in formula (I) can be synthesized.

The condensation reaction of the process (i) can produce a good result if an organic base such a pyridine or the like is used therein as acid removing agent.

The halogenation of the side chain in the process (ii) can be effected using chlorine, sulfuryl chloride, bromine, N-chlorosuccinimide, N-bromosuccinimide, or so on. Upon halogenation, it is desired that a radical initiator such as benzoyl peroxide (BPO), azobisisobutylonitrile (AIBN) or the like should be used. Also, it is sometimes effective to irradiate the halogenation system with light.

In the condensation reaction of the process (iii), it is advantageous to use an organic base such as triethylamine or the like, or an inorganic base such as potassium carbonate or the like. In addition, the reaction proceeds smoothly when sodium salt of thiol prepared in advance is used together.

3-Methylindazole employed as starting material can be synthesized using the method described in *Chem. Heterocycl. Compounds,* Vol. 22, p. 1 (1967), in which 2-aminoacetophenone is converted into the corresponding oxime, and the oxime undergoes a dehydrating ring-closure reaction using acetic anhydride to produce the intended indazole. On the other hand, the desired ring-closure reaction can be effected by using 2-aminoacetophenone as starting material, producing the corresponding diazonium salt, and reducing the diazonium salt to convert it into the hydrazine, as irrustrated below.

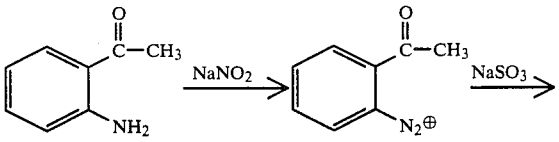

-continued

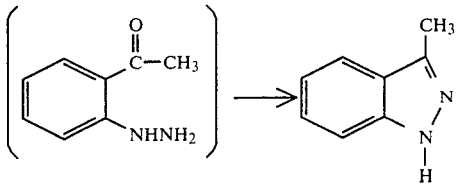

In addition, the compound of the present invention which contains a hydrogen atom as the substituent R in formula (I) can be obtained by heating the corresponding compound which has an acetyl group as the substituent R in an alcohol in the presence of an acid catalyzer, as illustrated below.

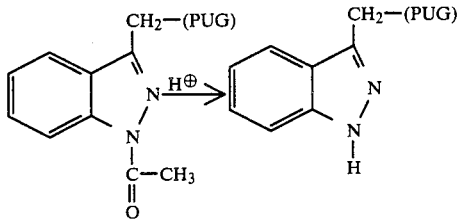

Specific synthesis examples of the compounds of the present invention are described in detail below.

SYNTHESIS EXAMPLE 1

Synthesis of Compound (6)

(1) Synthesis of 3-Methylindazole

A suspension containing 300 g (2.22 mol) of 2-aminoacetophenone, 580 ml of aqueous hydrochloric acid and 300 ml of water was cooled to from 0° to 3° C. and thereto, an aqueous solution (300 ml) containg 162 g (2.35 mol) of sodium nitrite was added dropwise over an one-hour period as a temperature of the reaction system was maintained at that temperature. After the conclusion of the dropwise addition, the resulting mixture was stirred at a temperature of from 0° to 3° C. for 15 minutes to prepare an aqueous solution of the diazonium salt.

To this solution were added 720 g (5.71 mol) of sodium sulfite and 2.5 liter of water, and the resulting mixture was stirred at a temperature of from 65° to 70° C. for 2 hours. Then, 200 ml of aqueous hydrochloric acid and 200 ml of water were added to the reaction mixture, and stirring was continued at a temperature of from 65° to 70° C. for additional two hours. The thus obtained light reddish-brown solution was cooled to 20° C. and 500 g of sodium acetate was added thereto, to change the pH of the resulting solution to about 4. Thereupon, light reddish-brown crystals separated out. After 30 minutes of stirring at a temperature of from 10° to 15° C., the crystals were filtered off, and washed with water. Thus, 291.4 g (2.21 mol) of 3-methylindazole was obtained.

(2) Synthesis of 1-Acetyl-3-methylindazole 290 g (2.20 mol) of 3-methylindazole and an acetonitrile solution (400 ml) of pyridine (4.34 mol) were stirred as the mixture was cooled on a water bath, and 310 ml (3.30 mol) of acetic anhydride was added dropwise thereto. Upon addition, the reaction temperature rose from 15° C. to 43° C. After the conclusion of the dropwise addition, the reaction solution was warmed to from 55° to 60° C., and stirred at this temperature for one hour. After cooling to 20° C., the reaction solution was poured into 1.5 kg of ice-cold water containing 500 ml of aqueous hydrochloric acid. The crystals deposited were filtered off, and washed with water. Thus, 328 g (1.89 mol) of 1-acetyl-3-methylindazole was obtained.

(3) Synthesis of 1-Acetyl-3-bromomethylindazole

A mixture of 320 g (1.84 mol) of 1-acetyl-3-methylindazole, 327 g (1.84 mol) of N-bromosuccinimide and 3 liters of carbon tetrachloride solution containing 0.2 g of benzoyl peroxide was refluxed over a 2-hour period as the mixture was irradiated with light. After cooling to room temperature, 0.2 g of benzoyl peroxide was further added, and the reaction mixture was refluxed for additional three hours. After conclusion of the refluxing step, the reaction mixture was cooled to 20° C. to precipitate succinimide. The precipitate of succinimide was filtered out, and the filtrate was concentrated under reduced pressure. To the residue was added 1.2 liters of n-hexane to precipitate crystals. The crystals was filtered off, and washed with n-hexane. Thus, 275 g of crude bromomethyl body was obtained. It was found from measurements of thin-layer chromatograph and NMR spectrum that the crude bromomethyl body was contaminated by about 17% of dibromomethyl body.

(4) Synthesis of Compound (6)

A 270 g portion of the above-described crude bromomethyl body, 195 g (0.852 mol) of 2-mercaptobenzimidazole-5-sulfonamide and 3 liters of acetone solution containing 147 g (1.07 mol) of anhydrous potassium carbonate were refluxed for 3 hours and then, the resulting mixture was allowed to stand for one night. The thus deposited crystals were filtered off, washed with acetone and further, washed with water three times so that inorganic salt contaminants would be extracted therewith. The resulting crystals was suspended in 1.5 liters of acetone, and stirred at room temperature for one hour. The suspension was filtered off, and washed with acetone. Thus, the intended conpound (6) was obtained. Yield: 240 g (0.598 mol). Melting point: 193° to 195° C.

SYNTHESIS EXAMPLE 2

Synthesis of Compound (8)

A solution containing 20 g (0.05 mol of Compound (6)) dissolved in 100 ml of methanol, to which several drops of sulfuric acid were added, was refluxed for 1 hour. Then, methanol was concentrated under reduced pressure, and to the residue was added a mixed solvent of acetone and ethyl acetate (1:1 by volume). Thereupon, viscous oil separated out. The supernatant liquid was removed by decantation, and to the residue was added 100 ml of ethyl acetate to bring about crystallization. The thus produced crystals were washed with 100 ml of acetone under reflux for 10 minutes, cooled to room temperature, and filtered off. The resulting crystals were dissolved in 150 ml of methanol under heating. The insoluble matter was filtered out, and the mother liquor was concentrated under reduced pressure. To the residue, 100 ml of acetone was added. Thereupon, crystals separated out, and were filtered off. Thus, the intended compound was obtained in a yield of 11.3 g (0.031 mol). Melting point: 210° to 211° C. (decomposed).

Silver halides usable in the present invention include silver chloride, silver bromide, silver iodide, silver chlorobromide, silver chloroiodide, silver iodobromide, and silver chloroiodobromide. Halide composition of the silver halide grains may be uniform throughout, or the interior and the surface of the silver halide grains may differ in halide composition. That is, the grains may have a multilayer structure (as described in Japanese Patent Application (OPI) Nos. 154232/82, 108533/83, 48755/84, and 52237/84, U.S. Pat. No. 4,433,048, and European Pat. No. 100,984). In addition, tabular grains having a thickness of 0.5 μm or less, a diameter of at least 0.6 μm and a mean aspect ratio of 5 or more (as described in U.S. Pat. Nos. 4,414,310 and 4,435,499, German Patent Application (OLS) No. 3,241,646 A1, and so on), or monodisperse emulsions having a nearly uniform grain size distribution (as described in Japanese Patent Application (OPI) Nos. 178235/82, 100846/83, and 14829/83, PCT Internationally Laid-Open Patent 83/02338A1, European Pat. Nos. 64,412 3A and 83,337 A1, and so on) can be used in the present invention. Two or more kinds of silver halides differing in crystal habit, halide composition, grain size, grain size distribution or so on may be used as a mixture. Also, two or more kinds of monodisperse dispersions differing in grain size may be used in a mixed condition for the purpose of controlling gradation.

A suitable grain diameter of the silver halide grains usable in the present invention ranges from 0.001 to 10 m on the average, preferably from 0.001 to 5 μm. These silver halide emulsions may be prepared using an acid process, a neutral process or an ammonia process, and suitable methods for reacting a water-soluble silver salt with a water-soluble halide include a single jet method, a double jet method and a combination thereof. A method in which silver halide grains are produced in the presence of excess silver ion (the so-called reversal mixing method), or the so-called controlled double jet method, in which the pAg is maintained constant, may also be employed in the present invention. Further, in order to accelerate the grain growth, addition concentrations, addition amounts or addition rates of a water-soluble silver salt and a water-soluble halide may be increased (as described in Japanese Patent Application (OPI) Nos. 142329/80 and 158124/80, U.S. Pat. No. 3,650,757, and so on).

Moreover, silver halide grains of the epitaxial junction type (Japanese Patent Application (OPI) No. 16124/81, and U.S. Pat. No. 4,094,684) can be used herein.

When a silver halide is used independently without used in combination with an organic silver salt oxidizer, it is desired in the present invention that silver chloroiodide, silver iodobromide or silver chloroiodobromide which shows the X-ray pattern characteristic of silver iodide crystals is used.

Such a silver salt as described above can be prepared, for example, by adding a silver nitrate solution to a potassium bromide solution to produce silver bromide grains and then, by further adding potassium iodide thereto to result in production of silver iodobromide having the above-described characteristic.

At the stage of forming silver halide grains to be used in the present invention, ammonia, organic thioether derivatives as described in Japanese Patent Publication No. 11386/72, or sulfur-containing compounds as described in Japanese Patent Application (OPI) No. 144319/78 can be employed as silver halide solvent.

In a process for forming silver halide grains or allowing the formed grains to ripen physically, cadmium salts, zinc salts, lead salts, thallium salts and/or so on may be present.

Further, for the purpose of making improvements in high intensity reciprocity law failure and low intensity reciprocity law failure, water-soluble iridium salts such as iridium (III, IV) chlorides, ammonium hexachloroiridates and the like, or water-soluble rhodium salts such as rhodium chloride or the like can be employed.

Removal of the soluble salts from the silver halide emulsion of the present invention may be carried out after the formation of the silver halide grains or after physical ripening, and for this purpose, the well-known noodle washing method or a sedimentation process can be employed.

The silver halide emulsion of the present invention is, though it may be a so-called primitive emulsion, usually chemically sensitized. In sensitizing chemical emulsions for photosensitive materials of conventional type, known sulfur sensitization techniques, reduction sensitization techniques, noble metal sensitization techniques and so on can be employed individually or as a combination thereof. These sensitizing steps can also be carried out in the presence of nitrogen-containing heterocyclic compounds (as described in Japanese Patent Application (OPI) Nos. 12526/83 and 215644/83).

The silver halide emulsions to be used in the present invention may be either those which form latent images predominantly at the surface of the grains, that is, surface latent image type emulsions, or those which form latent images mainly inside the grains, that is, internal latent image type emulsions. Direct reversal emulsions in which internal latent image type emulsions and nucleating agents are used in combination can also be employed in the present invention. Internal latent image type emulsions suitable for this purpose are described in U.S. Pat. Nos. 2,592,250 and 3,761,276, Japanese Patent Publication No. 3534/83, Japanese Patent Application (OPI) No. 136641/82, and so on. Nucleating agents suitable for the combined use in the present invention are described in U.S. Pat. Nos. 3,227,552, 4,245,037, 4,255,511, 4,266,031, and 4,276,364, German Patent Application (OLS) No. 2,635,316, and so on.

A suitable coverage of the light-sensitive silver halides to be used in the present invention ranges from 1 $mg/m^2$ to 10 $g/m^2$, based on the silver content.

In the present invention, an organic metal salt stable relatively to light can be used as oxidizing agent together with light-sensitive silver halide. In this case, it is necessary for the light-sensitive silver halide and the organic metal salt to be in contact with or very close to each other. Of organic metal salts of the above-described kind, organic silver salts are employed to particular advantage. When heat-developable photosensitive materials in which organic silver salts as described above are used in combination with silver halides are heated up to temperatures of 80° C. or above, preferably 100° C. or above, the organic metal salt oxidizers also participate in the redox reaction, utilizing latent images of silver halides as a catalyst.

As examples of organic compounds which can be used for producing the above-described organic silver salt oxidizers, mention may be made of aliphatic and aromatic carboxylic acids, thiocarbonyl group-containing compounds which additionally contain a mercapto group or an α-hydrogen, and imino group-containing compounds.

Typical examples of silver salts of aliphatic carboxylic acids include silver salts derived from behenic acid, stearic acid, oleic acid, lauric acid, capric acid, myristic acid, palmitic acid, maleic acid, fumaric acid, tartaric acid, furoic acid, linolic acid, linolenic acid, oleic acid, adipic acid, sebasic acid, succinic acid, acetic acid, butyric acid, and camphoric acid, respectively. Halogen- or hydroxyl group-substituted compounds of the above-described fatty acids, or silver salts derived from aliphatic carboxylic acids containing a thioether groups can also be employed.

Typical examples of silver salts of aromatic carboxylic acids and other carboxyl group-containing compounds include silver salts derived from benzoic acid, 3,5-dihydroxybenzoic acid, o-, m- or p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazoline-2-thione, respectively. Suitable examples of silver salts of mercapto or thiocarbonyl group-containing compounds include 3-mercapto-4-phenyl-1,2,4-triazole, 2-mercaptobenzoimidazole, 2-mercapto-5-aminothiadiazole, 2-mercaptobenzothiazole, S-alkylthioglycolic acids (alkyl moieties of which contain from 12 to 22 carbon atoms), dithiocarboxylic acids like dithioacetic acid, thioamides like thiostearoamide, 5-carboxy-1-methyl-2-phenyl-4-thiopyridine, mercaptotriazine, 2-mercaptobenzoxazole, mercapto compounds described in U.S. Pat. No. 4,123,274, such as mercaptooxadiazole, 3-amino-5-benzylthio-1,2,4-triazole, and so on.

Typical examples of silver salts of imino group-containing compounds include those derived from benzotriazole or the derivatives thereof described in Japanese Patent Publication Nos. 30270/69 and 18416/70, such as benzotriazole, alkyl-substituted benzotriazoles like methylbenzotriazole, halogen-substituted benzotriazoles like 5-chlorobenzotriazole, and carboimidobenzotriazoles like butylcarboimidobenzotriazole; nitrobenzotriazoles described in Japanese Patent Application (OPI) No. 118639/83; sulfobenzotriazoles, carboxybenzotriazole or the salts thereof, hydroxybenzotriazole and so on described in Japanese Patent Application (OPI) No. 118638/83; 1,2,4-triazoles and 1H-tetrazoles described in U.S. Pat. No. 4,220,709; carbazole, saccharin, imidazole, and derivatives thereof, and so on.

In addition, silver salts described in *Research Disclosure,* RD No. 17029 (June 1978), organic metal salts other than silver salts, such as copper stearate, and silver salts of alkyl group-containing carboxylic acids, such as phenylpropiolic acid and so on, described in Japanese Patent Application No. 221535/83 can also be used in the present invention.

The organic silver salts described above can be used in an amount of from 0.01 to 10 moles, preferably from 0.01 to 1 mole, per 1 mole of light-sensitive silver halide. A suitable combined coverage of light-sensitive silver halides and organic silver salts amounts to from 50 $mg/m^2$ to 10 $g/m^2$.

Silver halides which can be used in the present invention may be spectrally sensitized using methine dyes or other dyes. Specific spectral sensitizing dyes which can be employed include cyanine dyes, merocyanine dyes, complex cyanine dyes, complex merocyanine dyes, holopolar cyanine dyes, hemicyanine dyes, styryl dyes, and hemioxonol dyes. Especially useful dyes are cyanine dyes, merocyanine dyes and complex merocyanine dyes. Any nuclei usually present in cyanine dyes can be the basic heterocyclic nuclei of these dyes. More specifically, basic heterocyclic nuclei include pyrroline, oxazoline, thiazoline, pyrrol, oxazole, thiazole, selenazole, imidazole, tetrazole, pyridine and like nuclei, nuclei formed by fusing together one of the above-described nuclei and an alicyclic hydrocarbon ring; and nuclei formed by fusing together one of the above-described nuclei and an aromatic hydrocarbon ring. Specific examples of these nuclei include indolenine, benzindolenine, indole, benzoxazole, naphthoxazole, benzothiazole, naphthothiazole, benzoselenazole, benzimidazole, quinoline, and like nuclei. Each of these nuclei may be substituted on its carbon atom.

The merocyanine and complex merocyanine dyes can contain 5- or 6-membered heterocyclic nuclei such as pyrazoline-5-one, thiohydantoin, 2-thioxazolidine-2,4-dione, thiazolidine-2,4-dione, rhodanine, thiobarbituric acid, and like nuclei, as ketomethylene structure-containing nuclei.

These sensitizing dyes may be employed individually or in combination. Combinations of sensitizing dyes are often employed for the purpose of supersensitization.

Substances which can exhibit a supersensitizing effect in a combination with a certain sensitizing dyes although they themselves do not spectrally sensitize silver halide emulsions or do not absorb light in the visible region may be incorporated into the silver halide emulsions. For example, aminostyryl compounds substituted with nitrogen-containing heterocyclyl groups (for instance, as described in U.S. Pat. Nos. 2,933,390 and 3,653,721), aromatic organic acid-formaldehyde condensates (for instance, as described in U.S. Pat. No. 3,743,510), cadmium salts, azaindene compounds and so on can be used. Combinations described in U.S. Pat. Nos. 3,615,613, 3,615,641, 3,617,295, and 3,635,721 are especially useful.

These sensitizing dyes may be dispersed directly into a silver halide photographic emulsion, or they may be added thereto in a condition that they are dissolved in an appropriate solvent, such as water, methanol, ethanol, acetone, methyl cellosolve, or a mixture of two or more thereof. On the other hand, it may be carried out that these sensitizing dyes are dissolved in a solvent which is substantially immiscible with water, such as phenoxyethanol or so on, dispersed into water or a hydrophilic colloid, and then added to a photographic emulsion. Further, these sensitizing dyes can be added to a photographic emulsion simultaneously with addition of dye-providing substances in the form of a mixture thereof. In dissolving those sensitizing dyes, sensitizing dyes to be used in combination may be dissolved separately, or they may be dissolved in a mixed condition. In addition the solutions prepared in the above-described manners to a photographic emulsion, the separate solutions may be added simultaneously as a mixed solution or independently, or they may be added simultaneously with other additives. A suitable time to add those sensitizing dyes to photographic emulsions may be during, before, or after the chemical ripening, or before or after the nucleation of silver halide grains according to U.S. Pat. Nos. 4,183,756 and 4,225,666.

An appropriate amount of a sensitizing dye added is generally of the order of from $10^{-8}$ to $10^{-2}$ mole per 1 mole of silver halide.

When light-sensitive silver halides are reduced to silver under a high temperature condition in the present invention, compounds capable of producing or releasing mobile dyes in correspondence or counter-correspondence to this reaction, that is, dye-providing substances are allowed to be present.

Descriptions of dye-providing substances are given below.

Couplers which can react with developing agents constitute one type of dye-providing substances usable in the present invention. The manner of utilizing these couplers involves formation of dyes through reaction of coupler with oxidation products of developing agents which are produced by the redox reaction of silver salts with the developing agents. Specific examples of developing agents and couplers are described in detail, for example, in T. H. James, *The Theory of the Photographic Process,* 4th Ed., pp. 291–334, and pp. 354–361, MacMillan 1977; Shin-ichi Kikuchi, *Shashin Kagaku* (Photographic Chemistry), 4th Ed., pp. 284–295, Kyoritsu Shuppan, Tokyo, and so on.

As another example of dye-providing substances usable in the present invention, mention may be made of dye silver compounds in which organic silver salts are bound to dyes. Specific examples of dye silver compounds are described in *Research Disclosure,* RD No. 16966, pp. 54–58 (May 1978), and so on.

In addition, azo dyes which can be employed in heat developable silver-dye-bleach process can be cited as in instance of dye-providing substances. Specific examples of azo dyes and the bleach process are described in U.S. Pat. No. 4,235,957, *Research Disclosure,* RD No. 14433, pp. 30–32 (April 1976), and so on.

Further, leuco dyes described in U.S. Pat. Nos. 3,985,565, 4,022,617, and so on can be cited as another example of dye-providing substances.

Furthermore, compounds having a function so as to release a diffusible dye in an imagewise distribution or so as to diffuse imagewise, which can be utilized in the manner described, for example, in European Pat. No. 76,992, can be cited as still another example of dye-providing substances useful in the present invention.

Compounds of this type can be represented by formula (LI).

$$(\text{Dye—X})_n\text{Y} \qquad \text{(LI)}$$

In formula (LI), Dye represents a dye moiety or a precursor moiety thereof, X represents a mere bonding hand or a linkage group, Y represents a substrate having such a function as to change the diffusibility of the compound represented by formula $(\text{Dye—X})_n\text{Y}$ in correspondence or counter-correspondence to light-sensitive silver salts having latent image in imagewise distribution, or a substrate having such a property as to release Dye and that, bring about a difference in diffusibility between Dye released and $(\text{Dye—X})_n\text{Y}$, and n represents 1 or 2. When n is 2, the two (Dye—X)'s may be the same or different.

As specific examples of dye-providing substances represented by formula (LI), mention may be made of dye developers described in U.S. Pat. Nos. 3,134,764, 3,362,819, 3,597,200, 3,544,545, and 3,482,972, and so on, in which a hydroquinone type developer and a dye moiety are linked. As other specific examples, mention may be made of substances described in Japanese Patent Application (OPI) No. 63618/76, and so on, which release diffusible dyes by an intramolecular nucleophilic substitution reaction, and substances described in Japanese Patent Application (OPI) No. 111628/74, which release diffusible dyes when the iso-oxazolone ring contained therein changes its successive ring-opening-recyclization reaction. In the methods of utilizing the above-described dye-providing substances, respectively, such dye-providing substances release dyes or have diffusibility in the undeveloped areas, whereas in the developed areas they neither release dyes nor diffuse.

Moreover, the release or diffusion of dyes takes place in parallel with development in those methods. Therefore, it is very difficult for those methods to provide images having a desirably high signal to noise (image density/fog) ratio. Accordingly, a method has been conceived for the purpose of overcoming this problem. The method comprises previously incorporating a dye-releasing compound in its oxidized form, which does not have a dye-releasing ability, together with a reducing agent or its precursor, and reducing the oxidized form by the reducing agent which remains unoxidized upon development, to thus result in release of the diffusible dye from the dye-releasing compound. Specific examples of dye-providing substances which can be employed in the above-described method are described in Japanese Patent Application (OPI) Nos. 110827/78, 130927/79, 164342/81, and 35533/78.

On the other hand, as substances of a kind which enable the release of diffusible dyes in the developed areas, those which enable the release of a diffusible dye through the reaction of a coupler containing a diffusible dye moiety as an eliminable group with an oxidation product of a developer are described in British Pat. No. 1,330,524, Japanese Patent Publication No. 39165/73, U.S. Pat. No. 3,443,940, and so on. In addition, substances which enable the production of a diffusible dye through the reaction of a coupler containing a nondiffusible group as an eliminable group with an oxidation product of a developer are described in U.S. Pat. No. 3,227,550, and so on.

In the methods of utilizing these color developers, contamination of images with oxidative decomposition products of the developers can become a serious problem. For the purpose of solving this problem, dye-releasing compounds of the kind which have a reducing power in themselves, and therefore, require no developer are conceived. Typical examples of such compounds are illustrated below together with their respective literatures. Definitions of the substituents of the formulae illustrated below are as defined in the noted patents, patent applications, and other technical literature.

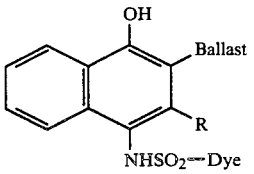

(U.S. Pat. No. 3,928,312, etc.)

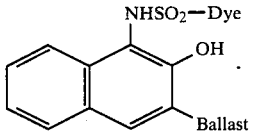

(U.S. Pat. No. 4,053,312, etc.)

-continued

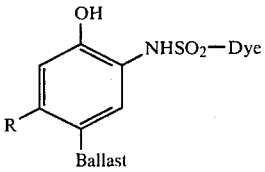

(U.S. Pat. No. 4,055,428, etc.)

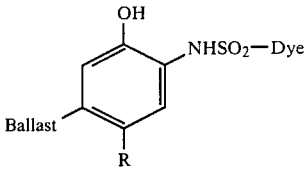

(U.S. Pat. No. 4,336,322)

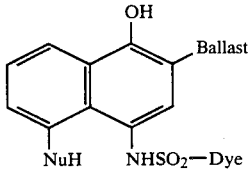

(Japanese Patent Application (OPI) No. 65839/84)

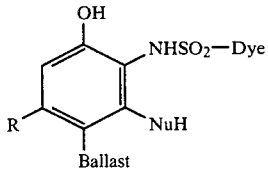

(Japanese Patent Application (OPI) No. 69839/84)

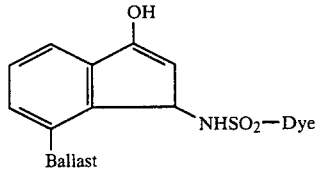

(Japanese Patent Application (OPI) No. 3819/78)

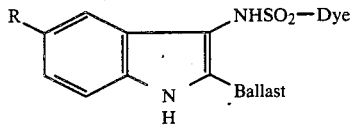

(Japanese Patent Application (OPI) No. 104343/76)

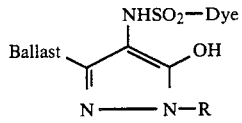

(Japanese Patent Application (OPI) No. 104343/76)

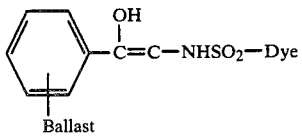

(Japanese Patent Application (OPI) No. 104343/76)

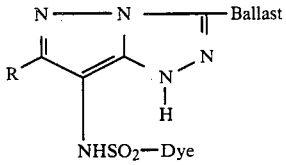

-continued (Research Disclosure, RD No. 17465, Oct. 1978)

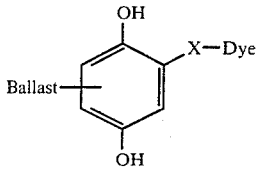

(U.S. Pat. No. 3,725,062)

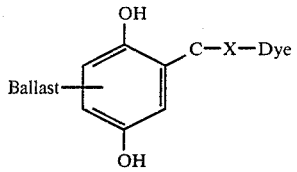

(U.S. Pat. No. 3,728,113)

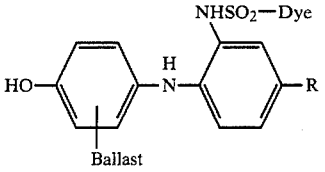

-continued (U.S. Pat. No. 3,443,939)

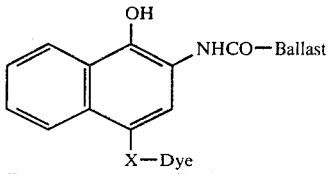

(Japanese Patent Application (OPI) No. 116537/83)

All of the above-described various kinds of dye-providing substances can be employed in the present invention.

Specific examples of image-forming substances that can be used in the present invention are described in the patent specifications set forth above. Since a listing of all of such compounds which can be used with advantage in the present invention would be unnecessarily verbose, a representative selection thereof are illustrated below as examples. Thus, specific examples of dye-providing substances represented by formula (LI) include the following compounds.

LI-1

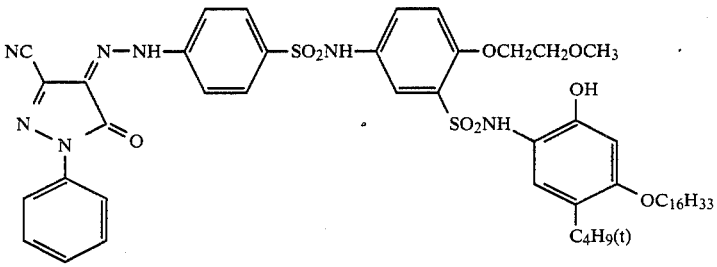

LI-2

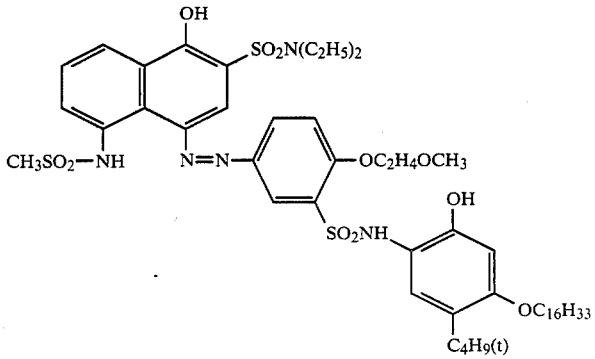

-continued
LI-3
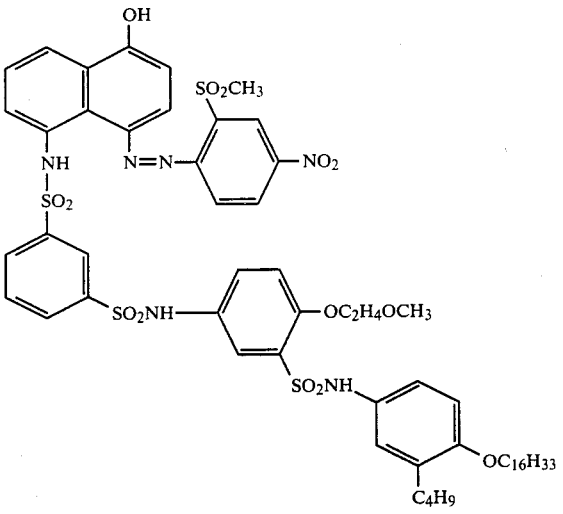
LI-4
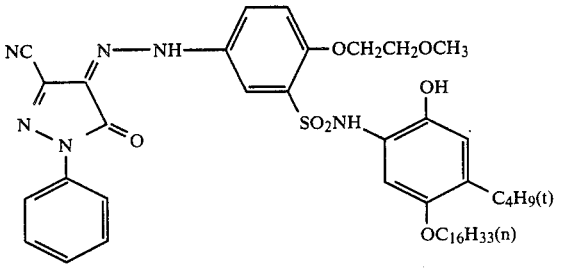
LI-5
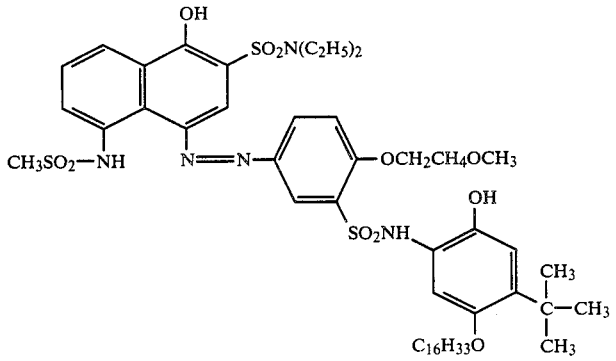
LI-6
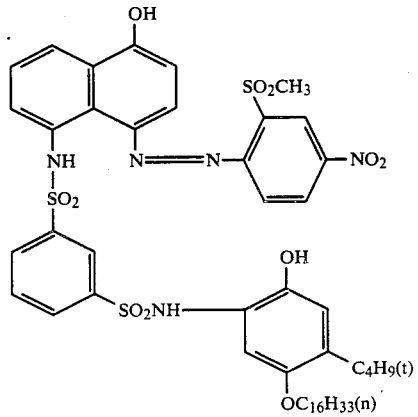

-continued
LI-7
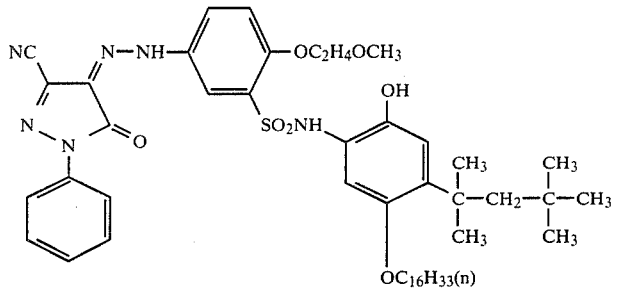
LI-8
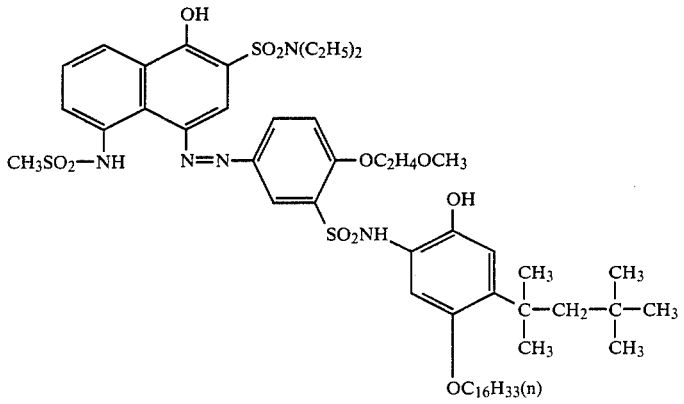
LI-9
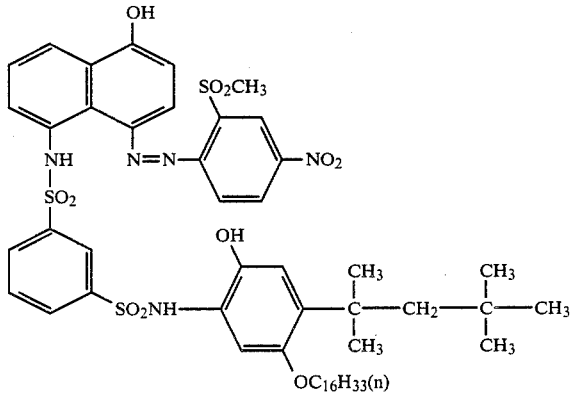
LI-10
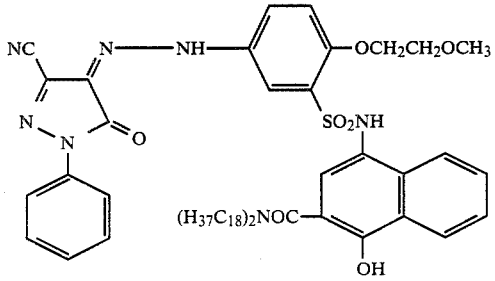

-continued
LI-11
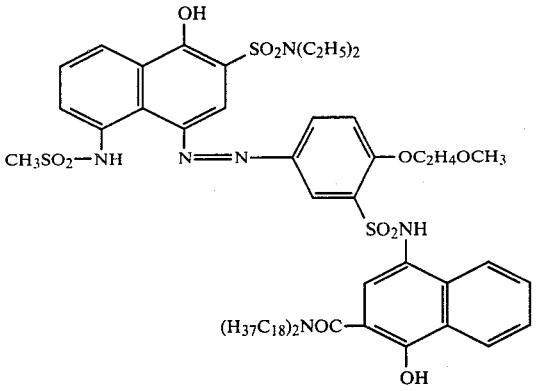
LI-12
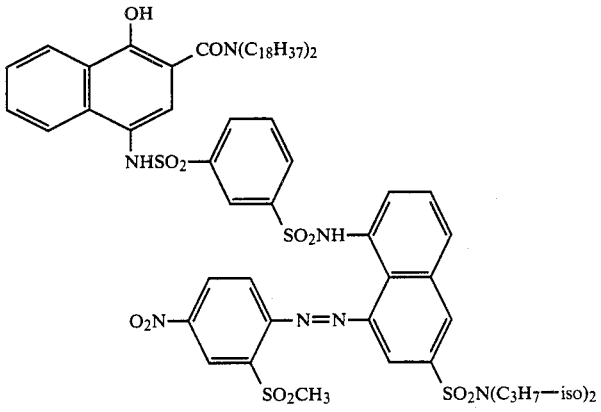
LI-13
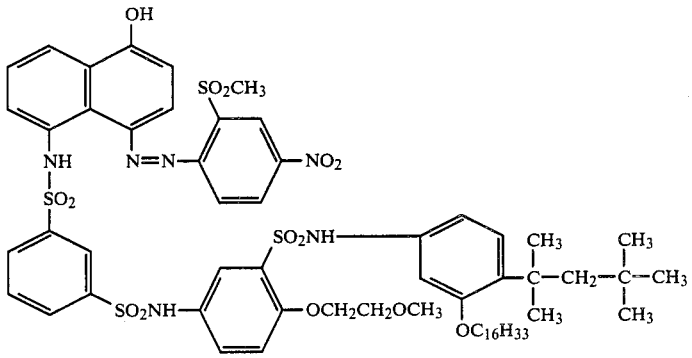
LI-14
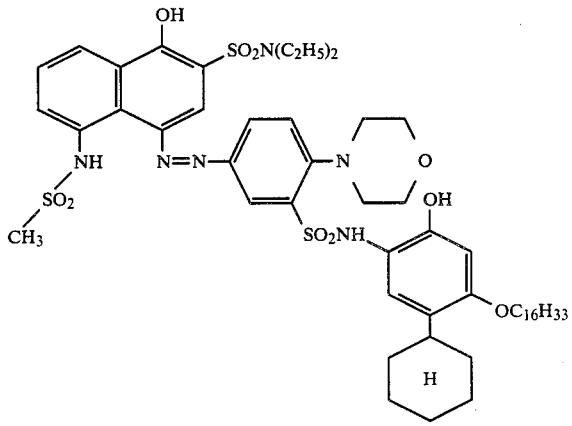

-continued

LI-15

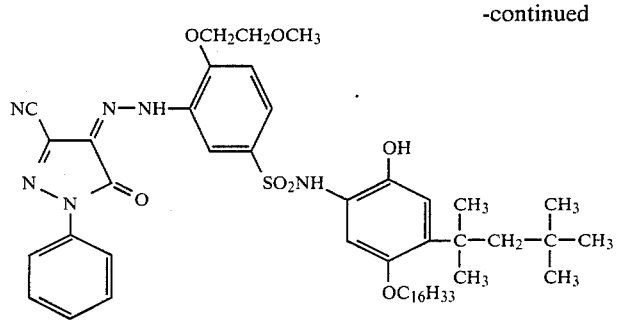

As the above-illustrated compounds are only part of examples, the present invention should not be construed as being limited to them.

Dye-providing substances as illustrated above can be introduced into the photosensitive material of the present invention using known methods as described, for example, in U.S. Pat. No. 2,322,027. Therein, high boiling point solvents and low boiling point solvents as set forth below can be employed.

For example, after dissolving the dye-providing substance in a high boiling point organic solvent, such as phthalic acid alkyl esters (e.g., dibutyl phthalate, dioctyl phthalate, etc.), phosphoric acid esters (e.g., diphenyl phosphate, triphenyl phosphate, tricresyl phosphate, dioctyl butyl phosphate, etc.), citric acid esters (e.g., tributyl acetylcitrate), benzoic acid esters, (e.g., octyl benzoate), alkylamides (e.g., diethllaurylamide), fatty acid esters (e.g., dibutoxyethyl succinate, dioctylazelate, etc.), trimesic acid esters (e.g., tributyl trimesate) or so on, or in an organic solvent having a boiling point of about from 30° C. to 160° C., such as lower alkyl acetates like ethyl acetate and butyl acetate, ethyl propionate, secondary butyl alcohol, methyl isobutyl ketone, $\beta$-ethoxyethyl acetate, methyl cellosolve acetate, cyclohexanone, or so on, the resulting solution is dispersed in a hydrophilic colloid. Upon dissolution of the dye-providing substances, the above-described high boiling point organic solvents and low boiling point solvents may be used in the form of a mixture of two or more thereof.

In addition, the dispersion technique using the polymers described in Japanese Patent Publication No. 39853/76 and Japanese Patent Application (OPI) No. 59943/76 can be employed. Moreover, various kinds of surface active agents can be employed at the time of dispersing the dye-providing substances into hydrophilic colloids. Suitable examples of surface active agents usable for this purpose include those set forth as surface active agents hereinafter.

It is proper in the present invention to use a high boiling point solvent as described above in an amount of 10 g or less, preferably 5 g or less, per 1 g of the dye-providing substance used.

It is desired in the present invention that a reducing substance should be incorporated in the photosensitive material. Suitable examples of reducing substances usable in the present invention include not only those known commonly as reducing agents, but also the foregoing dye-providing substances having a reducing power. In addition, precursors of reducing agents which can develop a reducing power through the interaction with a nucleophilic reagent or heat in the development step, although those having no reducing power can also be included therein.

Specific examples of reducing agents which can be used in the present invention include inorganic agents such as sodium sulfite, sodium hydrogen sulfite and so on, and organic ones such as benzenesulfinic acids, hydroxylamines, hydrazines, hydrazides, borane-amine complexes, hydroquinones, aminophenols, catechols, p-phenylenediamines, 3-pyrazolidinones, hydroxytetrones, ascorbic acid, 4-amino-5-pyrazolones, and so on. In addition, reducing agents described in T. H. James, *The Theory of the Photographic Process,* 4th Ed., pp. 291–334, can also be utilized. Further, precursors of reducing agents as described in Japanese Patent Application (OPI) Nos. 138736/81 and 40245/82, U.S. Pat. No. 4,330,617, and so on can be used to advantage. Furthermore, combinations of various developers as disclosed in U.S. Pat. No. 3,039,869 can be employed.

In the present invention, such a reducing agent is used in an amount of from 0.01 to 20 mole, preferably from 0.1 to 10 mole, per 1 mole of silver.

Image formation accelerators can be employed in the present invention. The image formation accelerators have the functions, for instance, of accelerating the redox reaction of silver salt oxidizers with reducing agents, of accelerating such reactions as the production of dyes, the decomposition of dyes, or the release of diffusible dyes from dye-providing substances, and so on, and of accelerating the transfer of dyes from some layer of a photosensitive material into dye-fixing layer. According to physico-chemical functions, the image formation accelerators can be classified into several groups, e.g., bases or the precursors thereof, nucleophilic compounds, oils, thermal solvents, surface active agents, compounds having interactions with silver or silver ion, and so on. However, these groups of substances have, in general, compound functions, and as is usual with these substances they have some of the above-described accelerating effects in combination.

Specific examples of these image formation accelerators are described below classifying them according to function. However, this classification is introduced for convenience's sake, and as a matter of fact, many of them combine plural functions.

(a) Bases

Suitable examples of bases include inorganic bases such as hydroxides, secondary and tertiary phosphates, borates, carbonates, quinolates and metaborates of alkali metals or alkaline earth metals; hydroxide of ammonium; hydroxides of quaternary alkylammoniums; hydroxides of other metals; and so on: and organic bases such as aliphatic amines (e.g, trialkylamines, hydroxylamines, aliphatic polyamines, etc.), aromatic amines (e.g., N-alkyl substituted aromatic amines, N-hydroxyalkyl substituted aromatic amines, and bis[p-(dialkylamino)phenyl]methanes), heterocyclic amines, amidines, cyclic amidines, guanidines, cyclic guanidines, and so on. In particular, those having a pKa value of 8 or higher are preferred over others.

(b) Base Precursors

Suitable precursors are those capable of releasing bases by undergoing certain reactions under heating, for instance, salts of bases and organic acids of the kind which decompose through decarboxylation upon heating, compounds capable of releasing amines through decomposition caused by an intramolecular nucleophilic substitution reaction, Lossen rearrangement, Beckmann rearrangement, etc., and so on. Specific examples of such precursors include salts of trichloroacetic acid as described in British Pat. No. 998,949 and so on, salts of α-sulfonylacetic acid described in U.S. Pat. No. 4,060,420, salts of propiolic acids described in Japanese Patent Application No. 55700/83, 2-carboxylcarboxamide derivatives described in U.S. Pat. No. 4,088,496, pyrolizable acid salts in which not only organic bases but also alkali metals and alkaline earth metals are employed as base components (described in Japanese Patent Application No. 69597/83), hydroxamcarbamates described in Japanese Patent Application No. 43860/83 in which Lossen rearrangement is utilized, aldoximecarbamates described in Japanese Patent Application No. 31614/83, which produce nitriles by heating, and so on. In addition, base precursors described in British Pat. No. 998,945, U.S. Pat. No. 3,220,846, Japanese Patent Application (OPI) No. 22625/75, British Pat. No. 2,079,480, and so on are also useful.

(c) Nucleophilic Compounds

Suitable examples of nucleophilic compounds include water and water-releasing compounds, amines, amidines, guanidines, hydroxylamines, hydrazines, hydrazides, oximes, hydroxamic acids, sulfonamides, active methylene compounds, alcohols, and thiols. In addition, salts and precursors of the above-described compounds can be used.

(d) Oils

High boiling point organic solvents (so-called plasticizers) used as solvent for emulsifying dispersions of hydrophobic compounds can be used, referring to pages 72 to 73.

(e) Thermal Solvents

Thermal solvents are substances which, though solid at ordinary temperatures, are melted when heated in the vicinity of development temperature and thereby, come to fulfil their functions as solvent. Of compounds belonging to ureas, urethanes, amides, pyridines, sulfonamides, sulfones, sulfoxides, esters, ketone and ethers, those which are present as a solid at temperatures lower than about 40° C. can be employed as thermal solvent.

(f) Surface Active Agents

Specific examples of surface active agents include pyridinium salts described in Japanese Patent Application (OPI) No. 74547/84, ammonium salts, phosphonium salts, and polyalkyleneoxides described in Japanese Patent Application (OPI) No. 57231/84.

(g) Compounds Interacting with Silver or Silver Ion

Specific examples of such compounds include imides, nitrogen-containing heterocyclic compounds described in Japanese Patent Application No. 51657/83, thiols described in Japanese Patent Application No. 222247/82, thioureas, and thioethers.

The image formation accelerators may be incorporated in either a photosensitive material or a dye-fixing material. Also, they may be incorporated in both of these materials. Specific examples of layers in which the image formation accelerators may be incorporated include an emulsion layer, an interlayer, a protective layer, a dye-fixing layer, and adjacent layers thereto. Also, in the case where a photosensitive material assumes a form having a photosensitive layer and a dye-fixing layer on the same support, the layers in which the image formation accelerators may be incorporated are similar to those described above.

The image formation accelerators may be used either independently or as a combination of several kinds thereof. In general, a combined use of several kinds of image formation accelerators can produce a greater effect.

In particular, when a base or a precursor of a base is used in combination with other accelerators, a more desirable effect can be obtained.

Of the compounds of the present invention, those containing as PUG the development inhibitors represented by formula (II) can achieve their effects particularly efficiently when used in combination with a precursor of a base.

In such a case, a preferred ratio of the base precursor to the compound of the present invention ranges from 1/20 to 20/1, and particularly preferably from 1/5 to 5/1, on a molar basis.

In addition, compounds capable of working for the stabilization of images simultaneously with the activation of development can be employed in the present invention. Specific examples of compounds which can be preferably used for such purposes include isothiuroniums represented by 2-hydroxyethylisothiuronium trichloroacetate described in U.S. Pat. No. 3,301,678, bis(isothiuronium) compounds like 1,8-(3,6-dioxaoctane)-bis(isothiuronium.trichloroacetate) described in U.S. Pat. No. 3,669,670, thiol compounds described in German Patent Application (OLS) No. 2,162,714, thiazolium compounds such as 2-amino-2-thiazolium trichloroacetate, 2-amino-5-bromoethyl-2-thiazolium trichloroacetate and the like described in U.S. Pat. No. 4,012,260, compounds containing 2-carboxycarboxyamido group as thier acidic part, such as bis(2-amino-2-thiazolium)methylenebis(sulfonylacetate), 2-amino-2-thiazoliumphenylsulfonylacetate and the like, described in U.S. Pat. No. 4,060,420, and so on.

Further, azole thioethers and blocked azolinethiones described in Belgian Patent 768,071, 4-aryl-1-carbamyl-2-tetrazoline-5-thione compounds described in U.S. Pat. No. 3,893,859, and compounds described in U.S. Pat. Nos. 3,839,041, 3,844,788, and 3,877,940 can also be employed to advantage.

Binders which can be employed in the present invention can be contained alone or as a combination in the photosensitive material. Such binders are hydrophilic ones. The representatives of hydrophilic binders are transparent or translucent ones. More specifically, natural substances such as proteins, e.g., gelatin, gelatin derivatives, etc., and polysaccharides, e.g., cellulose derivatives, starch, gum arabic, etc., and synthetic polymers such water-soluble polyvinyl compounds e.g., as polyvinyl pyrrolidone, acrylamide polymers etc. are included in binders of the above-described kind. Of other synthetic polymers, there are dispersible vinyl compounds which can increase in particular the dimensional stability of a photographic material when used in the latex form.

Coverage of the binder of the present invention is generally 20 g/m$^2$ or less, preferably 10 g/m$^2$ or less, and more preferably 7 g/m$^2$ or less.

In dispersing a high boiling point organic solvent into a binder together with hydrophobic compounds such as dye-providing substances and so on, it is generally appropriate to use the solvent in a quantity of 1 ml or less, preferably 0.5 ml or less, and more preferably 0.3 ml or less, per 1 g of binder.

The photosensitive material and the dye-fixing material of the present invention may contain an inorganic or organic hardener in their photographic emulsion layers or other binder layers. For example, chromium salts (e.g., chrome alum, chromium acetate, etc.), aldehydes (e.g., formaldehyde, glyoxal, glutaraldehyde, etc.), N-methylol compounds (e.g., dimethylolurea, methylol-dimethylhydantoin, etc.), dioxane derivatives (e.g., 2,3-dihydroxydioxane, etc.), active vinyl compounds (e.g., 1,3,5-triacryloylhexahydro-s-triazine, 1,3-vinylsulfonyl-2-propanol, 1,2-bis(vinylsulfonylacetamido)ethane, etc.), active halogen-containing compounds (e.g., 2,4-dichloro-6-hydroxy-s-triazine, etc.), mucohalogen acids (e.g., mucochloric acid, mucophenoxychloric acid, etc.), and so on can be used alone or as a combination thereof.

Supports to be used for the photosensitive material of the present invention, and optionally for the dye-fixing material, are those which can withstand processing temperatures to be employed. Examples of supports which can generally be used include not only glass, paper, metal and analogues thereof, but also acetylcellulose film, cellulose ester film, polyvinyl acetal film, polystyrene film, polycarbonate film, polyethylene terephthalate film, and their related films or resinous materials. In addition, paper supports laminated with polymers like polyethylene can be used. Moreover, polyesters described in U.S. Pat. Nos. 3,634,089 and 3,725,070 are used to advantage.

In the case where dye-providing substances capable of releasing mobile dyes in imagewise distribution are employed in the present invention, dye transfer assistants can be employed upon transfer of the dyes from the photosensitive layer to the dye-fixing layer.

When the dye transfer assistants are used in an externally applied form, specific examples thereof include water, and aqueous solutions of inorganic salts of alkali metals, such as sodium hydroxide, potassium hydroxide and so on. In addition, low boiling point solvents such as methanol, N,N-dimethylformamide, acetone diisobutylketone and the like, or mixed solutions of these low boiling point solvents with water or alkaline aqueous solutions can be employed. The dye transfer assistants may also be used in such a condition that the image-receiving layer may be moistened therewith.

If the dye transfer assistants are incorporated in the photosensitive material or the dye-fixing material, it is not longer needed to externally supply them to these materials. Dye transfer assistants as described above may be incorporated in the photosensitive or dye-fixing material as water of crystallization or in the form of microcapsules, or as the precursors capable of releasing solvents as set forth above under high temperatures. It is more desirable to employ hydrophilic thermal solvents of the kind which, though solid at ordinary room temperature (20° C.), melt at higher temperatures. Hydrophilic thermal solvents may be incorporated in either the photosensitive material or the dye-fixing material. Of course, they may be incorporated in both of these materials. More specifically, it is more advantageous to incorporate them in dye-fixing layers and/or in layers adjacent thereto, although they may be incorporated in any constituent layer, e.g., emulsion layers, interlayers, protective layers, dye-fixing layers, or so on.

Suitable examples of hydrophilic thermal solvents include ureas, pyridines, amides, sulfonamides, imides, alcohols, oximes, and other heterocyclic compounds.

In the photosensitive material to be used in the present invention, filter dyes, absorbents and the like, as described in Japanese Patent Publication No. 3692/73, U.S. Pat. Nos. 3,253,921, 2,527,583, and 2,956,879, and so on, can be incorporated in order to improve sharpness of the images. Of these dyes, heat decolorizable dyes are more advantageous, and specific examples of such dyes are described in U.S. Pat. Nos. 3,769,019, 3,745,009, and 3,615,432, and so on.

The photosensitive material of the present invention can optionally contain various kinds of additives known to be useful for conventional heat-developable photosensitive materials, and can have layers other than photosensitive layers, for example, an antistatic layer, a conductive layer, a protective layer, an interlayer, an antihalation layer, a peel-apart layer, and so on, if desired. Such additives are further described in Research Disclosure, Vol. 170, No. 17029 (June 1978). For example, plasticizers, sharpness improving dyes, antihalation dyes, sensitizing dyes, matting agents, surface active agents, brightening agents, discoloration inhibitors and so on, can be employed.

The photographic element of the present invention is constructed by a photosensitive element which can produce or release dyes by heat development, and a dye-fixing element which can fix resulting dyes, if desired. In particular, both of the photosensitive element and the dye-fixing element are indispensable for the system of forming images through the diffusion transfer of dyes. The above-described system of photographic elements may have the structure in which the photosensitive element and the dye-fixing element are coated on two separate supports, or the structure in which both elements are provided on the same support.

Photographic elements having the structure in which the photosensitive element and the dye-fixing element are provided on separate supports are classified into two general groups. One group includes those of the peel-apart type, and the other group includes those of the non-peel-apart type. In the case where the photographic element has a structure of the peel-apart type, the coated face of the photosensitive element is brought into contact with the coated face of the dye-fixing element after imagewise exposure or heat development, and at the conclusion of the formation of transferred images the photosensitive element is peeled quickly from the dye-fixing element. An opaque support or a transparent one is chosen as the support of the dye-fixing element depending upon whether the final image is an image of the reflection type or one of the transmission type. In addition, a white reflective layer may be provided, if desired. In case of the non-peel-apart type of photographic elements, it is necessary to arrange a white reflective layer between the photosensitive layer in the photosensitive material and the dye-fixing layer in the dye-fixing element. The white reflective layer may be provided in either the photosensitive element or the dye-fixing element. Further, the support of the dye-fixing element must be transparent.

The structure which does not require the peeling of the photosensitive element from the image-receiving element after the formation of transferred images is one of the representatives of structures in which both the photosensitive and the dye-fixing elements are provided on the same support. In this case, a transparent or opaque support is coated with a photosensitive layer, a dye-fixing layer, and a white reflective layer. A preferred order of these layers may be transparent or opaque support/photosensitive layer/white reflective layer/dye-fixing layer, or transparent support/dye-fixing layer/white reflective layer/photosensitive layer.

Another representative of the structures in which the photosensitive element and the dye-fixing element are provided on the same support is the structure which is so designed as to peel a part or all of the photosensitive element from the dye-fixing element, as described in Japanese Patent Application (OPI) No. 67840/81, Canadian Pat. No. 674,082, U.S. Pat. No. 3,730,718, and so on. Therein, a peeling-apart layer is provided in an appropriate position.

The photosensitive element or the dye-fixing element may have a structure in which an electrically conductive exothermic layer is provided as a heating means for heat development or diffusion transfer of dyes.

In order to obtain various kinds of colors within the range of the chromaticity diagram using three primary colors, i.e., blue, green and red, the photosensitive element to be used in the present invention must have at least three silver halide emulsion layers having their own sensitivities in different spectral regions.

Typical examples of the combination of at least three kinds of photosensitive silver halide emulsion layers, which have their own sensitivities in spectral regions different from one another, include the combination of a blue-sensitive emulsion layer, a green-sensitive emulsion layer and a red-sensitive emulsion layer, that of a green-sensitive emulsion layer, a red-sensitive emulsion layer and an infrared-sensitive emulsion layer, that of a blue-sensitive emulsion layer, a green-sensitive emulsion layer and an infrared-sensitive emulsion layer, that of a blue-sensitive emulsion layer, a red-sensitive emulsion layer and an infrared-sensitive emulsion layer, and so on. The term "infrared-sensitive emulsion layer" signifies an emulsion layer having sensitivity to light of 700 nm or longer, particularly 740 nm or longer.

The photosensitive material of the present invention may have a photosensitive layer which is constructed by two or more emulsion layers having the same spectral sensitivity, but which differ in photographic speed from one another.

The above-described emulsion layers each and/or a light-insensitive hydrophilic colloid layer adjacent thereto are/is required to contain one of dye-providing substances which can produce or release a hydrophilic yellow, magenta, or cyan dye. That is to say, each emulsion layer and/or the light-insensitive hydrophilic colloid layer adjacent thereto is required to contain a dye-providing substance which can produce or release a hydrophilic dye differing in hue from other dyes which come to be present in other layers. Optionally, two or more kinds of substances which can provide dyes having the same hue may be used as a mixture. In the event that a colored dye-providing substance is employed, it is advantageous to incorporate the colored substance into other layer than the emulsion layer. In addition to the above-described layers, the photosensitive material of the present invention can optionally include auxiliary layers such as a protective layer, an interlayer, an antistatic layer, an anticurl layer, a peel-apart layer, a matting layer, and so on.

In particular, it is usual for the protective layer to contain an organic or inorganic matting agent for the purpose of preventing adhesion from occurring. Further, the protective layer may contain a mordant, a UV absorbent and so on. The protective layer and the interlayer each may be constructed by two or more layers.

The interlayer may contain a reducing agent for prevention of color stains, a UV absorbent, and a white pigment like $TiO_2$. White pigments may be added to not only the interlayer but also emulsion layers for the purpose of increasing the photographic speed.

In order to impart color sensitivities as described above to silver halide emulsions, respectively, each silver halide emulsion has only to be spectrally sensitized using some of known sensitizing dyes so that it may acquire a desired spectral sensitivity.

The dye-fixing element to be used in the present invention has at least one layer containing a mordant. When a dye-fixing layer is situated at the surface of the dye-fixing element, a protective layer may further be provided thereon, if desired.

Moreover, a water absorbing layer or a dye transfer assistant-containing layer can be provided for the purpose of sufficient impregnation with dye transfer assistant if desired, or in order to control the supply of dye transfer assistants. These layers may be adjacent to the dye-fixing layer, or they may be provided on the dye-fixing layer through an interlayer.

The dye-fixing layer used in the present invention may be constructed of two or more layers in which mordants differing in mordanting power are used, respectively.

In addition to the above-described layers, the dye-fixing element to be used in the present invention can have auxiliary layers, such as a peel-apart layer, a matting layer, an anticurl layer, etc., if desired.

In one or a plurality of the above-described layers, bases (including the precursors thereof) for accelarating the dye transfer and hydrophilic thermal solvents, antidiscoloration agents for prevention of color stains and UV absorbents latex-form vinyl compounds for enhancement of dimensional stability, brightening agents, and so on may be incorporated.

Suitable binders for the above-described layers are hydrophilic binders, and typical examples thereof include transparent or translucent hydrophilic colloids. For example, natural substances such as protein, e.g., gelatin, gelatin derivatives, etc., and polysaccharides, e.g., cellulose derivatives, starch, gum arabic, dextrin, etc., and synthetic polymers such as Pluran, polyvinyl alcohol, polyvinyl pyrrolidone, acrylamide polymers and other water-soluble vinyl compounds can be employed. Of these substances, gelatin and polyvinyl alcohol are particularly effective.

The dye-fixing element may have a reflective layer containing a white pigment like titanium oxide, a neutralizing layer, a neutralization timing layer and so on. These layers may be provided in the photosensitive element also. Constitutions of the above-described reflective layer, neutralizing layer and neutralization timing layer are described, for example, in U.S. Pat. Nos.

2,983,606, 3,362,819, 3,362,821, and 3,415,644, and Canadian Pat. No. 928,559.

Further, it is advantageous to the dye-fixing element of the present invention to have the form of containing transfer assistants described hereinafter. The transfer assistants may be incorporated in the dye-fixing layer or in another layer provided on their own account.

A transparent or translucent exothermic element used in the present invention when the electrothermo-heating is adopted as a developing means can be made in the form of a heating element of resistance-induced type using conventional known techniques.

Methods for making such a heating element include the method of utilizing a thin film of an inorganic material which manifests semiconductivity, and the method of utilizing an organic thin film made up of a conductive fine powder-binder dispersion. Specific examples of materials used in the former method include silicon carbide, molybdenum silicide, lanthanum chromate, barium titanate ceramics used as a PTC thermistor, tin oxides, zinc oxide, and so on, and these materials can be made into a transparent or opaque film using known techniques. Resistors having desired temperature characteristics which are used in the latter method can be made by dispersing conductive fine particles such as a metal fine powder, carbon black, graphite or so on into gum, a synthetic polymer, or gelatin. These resistors may be directly in contact with the photosensitive element, or they may be screened by a support, an interlayer or so on from the photosensitive element.

An image-receiving layer which can be used in the present invention may be a dye-fixing layer usable in heat developable color photosensitive materials. Dye-fixing agents to be used therein can be freely selected from generally used mordants. However, polymeric mordants are preferred over others. Suitable examples of polymeric mordants include polymers containing tertiary amino groups, polymers having nitrogen-containing heterocyclic ring moieties, polymers having quaternary cationic groups of nitrogen-containing rings, and so on.

Specific examples of polymers having vinyl monomer units containing tertiary amino groups are described in Japanese Patent Application Nos. 169012/83 and 166135/83, and so on, and those of polymers having vinyl monomer units containing tertiary imidazolyl groups are described in Japanese Patent Application Nos. 2226497/83 and 232071/83, U.S. Pat. Nos. 4,282,305, 4,115,124 and 3,148,061.

Specific examples of polymers having vinyl monomer units containing quaternary imidazolium salts are described in British Pat. Nos. 2,056,101, 2,093,041 and 1,594,961, U.S. Pat. Nos. 4,124,386, 4,115,124, 4,273,853 and 4,450,224, Japanese Patent Application (OPI) No. 28225/73, and so on.

Specific examples of polymers having vinyl monomer units containing other quaternary ammonium salts are described in U.S. Pat. Nos. 3,709,690, 3,898,088, and 3,958,995, Japanese Patent Application Nos. 166135/83, 169012/83, 232070/83, 232072/83, and 91620/84, and so on.

In carrying out imagewise exposure for recording images on heat developable photosensitive materials, radiation containing visible rays can be employed as light source. Suitable light sources which can be used include various kinds of ones which are generally used for color prints, for example, a tungsten lamp, a mercury lamp, a halogen lamp like an iodine lamp, a xenon lamp, a laser beam source, a CRT light source, a fluorescent lamp, a light-emitting diode (LED) and so on.

Suitable heating temperatures in the heat development step are within the range described hereinbefore. However, the lower limit thereof is preferably 140° C., and more preferably 150° C. An allowable heating temperature in the transfer step ranges from room temperature to a temperature employed in the heat development step. More preferred heating temperatures in the transfer step are up to a temperature lower than the temperature employed in the heat development step by about 10° C. Suitable examples of heating means which can be used in the heat development step and/or in the transfer step include a mere hot plate, a flatiron, a heating roller, a heating element utilizing carbon, titanium white or so on.

A dye transfer assistant (e.g., water) is given in a layer between a light-sensitive layer of the heat developable light-sensitive material and a dye-fixing layer of the dye-fixing material, or to a layer provided therebetween to result in acceleration of dye transfer. Also, the dye transfer assistant can be incorporated previously in the light-sensitive layer and/or the dye-fixing layer and then, both the layers are superposed upon each other.

Heating in the transfer step can be effected by passing the superposed materials through a pair of hot plates, bringing them into contact with a hot plate (e.g., as described in Japanese Patent Application (OPI) No. 62635/75), bringing them into contact with a rotating hot drum or roller (e.g, Japanese Patent Publication No. 10791/68), passing them through hot air (e.g., Japanese Patent Application (OPI) No. 32737/78), passing them through an inert liquid maintained at a prescribed temperature, guiding them along a heat source using a roller, a belt or other guiding means (e.g., Japanese Patent Publication No. 2546/69), and so on. On the other hand, such a means that a layer of an electrically conductive material, e.g., graphite, carbon black, metal or so on, is laminated on the dye-fixing material in advance, and the dye-fixing material is directly heated by passing an electric current through this conductive layer may be adopted.

Temperatures of the heating means as described above for enabling the transfer of images in the transfer step ranges from as high as the temperature employed for the heat development step to as low as room temperature. In particular, temperatures ranging from not lower than 60° C. to a temperature lower than that employed in the heat development step by 10° C. or more can generally bring about good results.

EXAMPLE 1

A silver iodobromide emulsion was prepared in the following manner.

In 3,000 ml of water, 40 g of gelatin and 26 g of KBr were dissolved. This solution was kept at 50° C. and stirred.

A solution prepared by dissolving 34 g of silver nitrate in 200 ml of water was added to the resulting solution over a 10-minute period.

Thereafter, a solution prepared by dissolving 3.3 g of potassium iodide in 100 ml of water was further added over a 2-minute period.

The thus prepared silver iodobromide emulsion causes precipitation therein and thereby, excess salts were removed.

Then, the emulsion was adjusted to a pH of 6.0. Thus, a desired silver iodobromide emulsion was obtained in a yield of 400 g.

Separately, a benzotriazole silver emulsion was prepared in the following manner.

In 3,000 ml of water were dissolved 28 g of gelatin and 13.2 g of benzotriazole. This solution was kept at 40° C., and stirred. Thereto, a solution prepared by dissolving 17 g of silver nitrate in 100 ml of water was added over a 2-minute period.

The pH of the resulting benzotriazole silver emulsion was controlled so as to cause flocculation therein and thereby, excess salts were removed. Thereafter, the emulsion was adjusted to pH 6.0. Thus, a desired benzotriazole silver emulsion was obtained in a yield of 400 g.

Further, a gelatin dispersion of a dye-providing substance (which has the same meaning as the foregoing image-forming substances, also in the following descriptions) was prepared as follows.

5 g of Dye-providing substance (1) having the formula illustrated below, 0.5 g of 2-ethylhexyl sodium sulfosuccinate, and 5 g of tricresyl phosphate (TPC) were weighed out, respectively, and admixed with 30 ml of ethyl acetate. The admixture was heated up to about 60° C., whereby it was converted into a homogeneous solution. This solution was mixed with 100 g of a 10% gelatin solution with stirring, and dispersed thereinto over a period of 10 minutes using a homogenizer rotating at 10,000 rpm. The thus obtained dispersion was designated as the dye-providing substance dispersion.

(1)

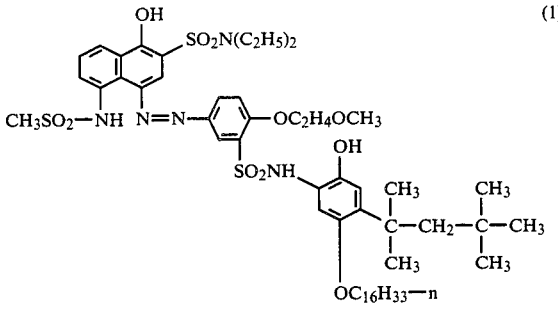

Furthermore, a gelatin dispersion of the compound of the present invention was prepared in the following manner.

3 g of Compound (6) of the present invention was added to 100 g of a 1% water solution of gelatin, and ground to fine grains for 10 minutes using a mill with the aid of 100 g of glass beads having a mean particle size of about 0.6 mm. Thereafter, the glass beads were removed by filtration. Thus, a gelatin dispersion of the compound of the present invention was obtained.

Sensitive materials A and B were produced in the following manner.

| Sensitive Material A: | |
|---|---|
| (a) Silver iodobromide emulsion | 20 g |
| (b) Benzotriazole silver emulsion | 10 g |
| (c) Dispersion of dye-providing substance | 33 g |
| (d) 5% water solution of compound illustrated below: | 10 ml |

-continued

Sensitive Material A:

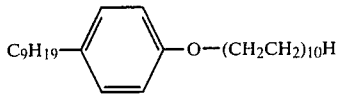

| | |
|---|---|
| (e) 10% water solution of compound illustrated below: | 4 ml |

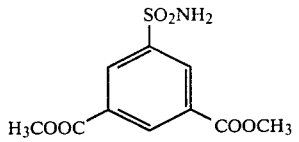

| | |
|---|---|
| (f) Solution containing 1.6 g of guanidine trichloroacetate (base precursor) dissolved in 16 ml of ethanol | |
| (g) Gelatin dispersion of Compound (6) of the present invention | 5 ml |
| (h) Water | 5 ml |

The above-described ingredients (a) to (h) were mixed, and dissolved by heating to prepare a coating composition. The composition was coated on a 180 μm-thick polyethylene terephthalate film in a layer having a wet thickness of 33 μm, and dried. On the thus-formed layer, a composition containing the following ingredients (p) and (q) was further coated in a wet thickness of 30 μm, and dried to provide a protective layer.

| | | |
|---|---|---|
| (p) | 10% water solution of gelatin | 30 ml |
| (q) | Water | 70 ml |

Thus, the sensitive material A was obtained.

| Sensitive Material B: | |
|---|---|
| (a) Silver iodobromide emulsion | 20 g |
| (b) Benzotriazole silver emulsion | 10 g |
| (c) Dispersion of dye-providing substance | 33 g |
| (d) 5% water solution of compound illustrated below: | 10 ml |

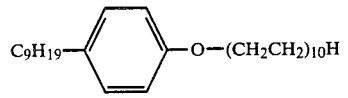

| | |
|---|---|
| (e) 10% water solution of compound illustrated below: | 4 ml |

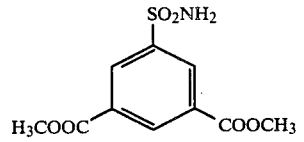

| | |
|---|---|
| (f) Solution containing 1.6 g of guanidine trichloroacetate (base precursor) dissolved in 16 ml of ethanol | |
| (g) Water | 10 ml |

The above-described ingredients (a) to (g) were mixed, and dissolved by heating to prepare a coating composition. The composition was coated on a 180 μm-thick polyethylene terephthalate film in a layer having a wet thickness of 33 μm, and dried. On the thus-formed layer was provided the same protective layer as that of the sensitive material A, to thus prepare the sensitive material B.

In addition, an image-receiving material having an image-receiving layer was prepared in the manner descried below.

Firstly, 0.75 g of the gelatin hardener H-1, 0.25 g of the gelatin hardener H-2, 160 ml of water, and 100 g of a 10% water solution of lime-processed gelatin were mixed homogeneously. The resulting mixture was coated uniformly in a layer having a wet thickness of 60 μm on a paper support which was laminated with a titanium oxide-dispersed polyethylene film, and dried.

Gelatin Hardener H-1:

$$CH_2{=}CHSO_2CH_2CONHCH_2CH_2NHCOCH_2SO_2CH{=}CH_2 \cdot$$

Gelatin Hardener H-2:

$$CH_2{=}CHSO_2CH_2CONHCH_2CH_2CH_2NHCOCH_2SO_2CH{=}CH_2$$

Then, 15 g of the polymer having the structure illustrated below (numerical subscripts indicate molar % values) was dissolved in 200 ml of water, and mixed homogeneously with 100 g of a 10% water solution of lime-processed gelatin. The resulting mixture was coated uniformly on the above-described gelatin coat in a wet thickness of 85 μm. The thus prepared sample was dried, and employed as a dye-fixing material.

Polymer

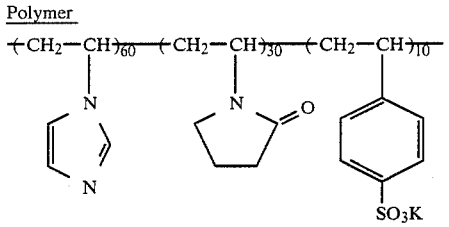

Each of the sensitive materials A and B was exposed imagewise for 10 seconds under illuminance of 2000 lux using a tungsten lamp, and heated uniformly for 30 seconds on a hot block kept at 140° C. or 143° C.

After dipping in water, the image-receiving material was superposed on the sensitive material heated in the above-described procedure in the condition that the coat side of the image-receiving material was in a face-to-face contact with the coat side of the sensitive material.

The superposed materials were heated for 6 seconds on a hot block kept at 80° C., and thereafter, the image-receiving material was peeled off from the sensitive material. Thereupon, a negative magnenta dye image was obtained on the image-receiving material. The density of this negative image was measured using a Macbeth reflection densitometer (RD-519). The results obtained are shown in the following table.

| Sensitive Material | Heating at 140° C. for 30 sec. Maximum Density | Heating at 140° C. for 30 sec. Minimum Density | Heating at 143° C. for 30 sec. Maximum Density | Heating at 143° C. for 30 sec. Minimum Density |
|---|---|---|---|---|
| A (Invention) | 2.14 | 0.15 | 2.19 | 0.22 |
| B (Comparison) | 2.18 | 0.19 | 2.24 | 0.35 |

As can be seen from the results of the above table, both increment of the maximum density and that of the minimum density resulting from the rise of development temperature by 3° C. were reduced by the use of the compound of the present invention. On the other hand, the sample for comparison, in which the compound of the present invention was absent, caused a marked increase in fog density by the rise of development temperature. Accordingly, the compound of the present invention has turned out to have a great effect on compensation for temperature change.

EXAMPLE 2

Samples C to G were prepared in the same manner as the sensitive material A in Example 1, except that the compounds listed in the table shown below, respectively, were employed in place of Compound (6) of the present invention in the coating composition A of Example 1, and processed in the same manner as in Example 1. The results obtained are shown in the following table.

| Sample | Compound No. | Heating at 140° C. for 30 sec. Maximum Density | Heating at 140° C. for 30 sec. Minimum Density | Heating at 143° C. for 30 sec. Maximum Density | Heating at 143° C. for 30 sec. Minimum Density |
|---|---|---|---|---|---|
| C | (4) | 2.16 | 0.17 | 2.18 | 0.21 |
| D | (7) | 2.04 | 0.15 | 2.11 | 0.19 |
| E | (9) | 2.06 | 0.15 | 2.14 | 0.20 |
| F | (26) | 2.11 | 0.16 | 2.18 | 0.22 |
| G | (24) | 2.13 | 0.14 | 2.15 | 0.21 |

As can be seen from the results of the above table, the compounds of the present invention has proved to have an excellent effect on compensation for temperature change.

EXAMPLE 3

A color sensitive material having a multilayer structure was prepared in the manner described below.

Sensitive Material H:

5 g of the yellow dye-providing substance having the structural formula (2) illustrated below, 0.5 g of 2-ethylhexyl sodium sulfosuccinate as a surface active agent, and 10 g of tri-iso-nonyl phosphate were weighed out respectively, and admixed with 30 ml of ethyl acetate. The admixture was heated to about 60° C., whereby it was converted into a homogeneous solution. This solution was mixed with 100 g of a 10% lime-processed gelatin solution with stirring, and dispersed therein over a period of 10 minutes using a homogenizer rotating at 10,000 rpm. The thus-obtained dispersion was called the dispersion of yellow dye-providing substance.

A dispersion of a magenta dye-providing substance was prepared in the same manner described above except that the magenta dye-providing substance (1) (illustrated in Example 1) was employed in place of the yellow dye-providing substance used above. Similarly, a dispersion of a cyan dye-providing substance having the structural formula (3) illustrated below was prepared.

A color sensitive material having the multilayer structure whose constituent layers are listed in the following table was produced using the above-described dispersions and other compositions also described in the following table.

(2)

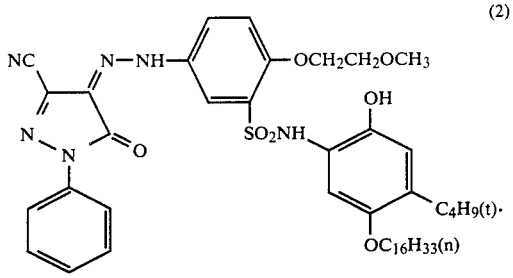

(3)

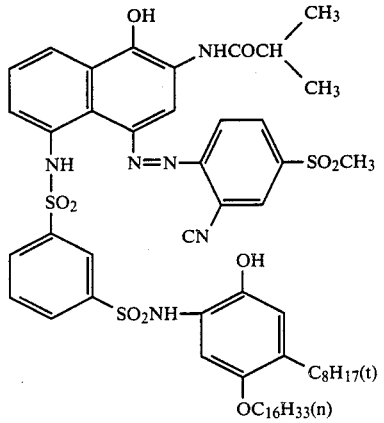

The 6th layer

Layer containing 1,000/m$^2$ of gelatin, 220 mg/m$^2$ of the base precursor*4 illustrated below, and 10 mg/m$^2$ of Compound (6) of the present invention.

The 5th layer

Blue-sensitive emulsion layer containing the silver iodobromide emulsion*3 (containing 10 mol% of silver iodide and 400 mg/m$^2$ of silver), 180 mg/m$^2$ of the compound*5 illustrated below, 510 mg/m$^2$ of the base precursor*4 illustrated below, 5 mg/m$^2$ of Compound (6) of the present invention, 400 mg/m$^2$ of the yellow dye-providing substance (2), 1,000 mg/m$^2$ of gelatin, 800 mg/m$^2$ of the high boiling point solvent*1 and 100 mg/m$^2$ of the surface active agent*2.

The 4th layer

Interlayer containing 1,200 mg/m$^2$ of gelatin, 220 mg/m$^2$ of the base precursor*4 illustrated below and 10 mg/m$^2$ of Compound (6) of the present invention.

The 3rd layer

Green-sensitive emulsion layer containing the silver iodobromide emulsion*3 (containing 10 mol% of silver iodide and 400 mg/m$^2$ of silver), 180 mg/m$^2$ of the compound*5 illustrated below, $10^{-6}$ of Sensitizing Dye (D-1), 510 mg/m$^2$ of the base precursor*4 illustrated below, 5 mg/m$^2$ of Compound (6) of the present invention, 400 mg/m$^2$ of the magenta dye-providing substance (10), 1,000 mg/m$^2$ of gelatin, 800 mg/m$^2$ of the high point solvent*1 and 100 mg/m$^2$ of the surface active agent*2.

The 2nd layer

Interlayer containing 1,000 mg/m$^2$ of gelatin, 230 mg/m$^2$ of the base precursor*4 illustrated below and 10 mg/m$^2$ of Compound (6) of the present invention.

The 1st layer

Red-sensitive emulsion layer containing the silver iodobromide emulsion*3 (containing 10 mol% of silver iodide and 400 mg/m$^2$ of silver), 180 mg/m$^2$ of the compound*5 illustrated below, $8\times10^{-7}$ mol/m$^2$ of Sensitizing Dye (D-2), 510 mg/m$^2$ of the base precursor*4 illustrated below, 5 mg/m$^2$ of Compound (6) of the present invention, 300 mg/m$^2$ of the cyan dye-providing substance (3), 1,000 mg/m$^2$ of gelatin, 600 mg/m$^2$ of the high boiling point solvent*1 and 100 mg/m$^2$ of the surface active agent*2.

Support

*1: $(iso\text{-}C_9H_{19}O)_3P{=}O$

*2: 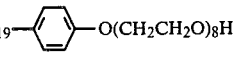

*3: Emulsion prepared in Example 1.

*4: 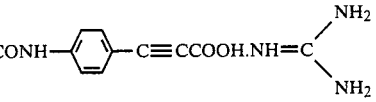

*5: 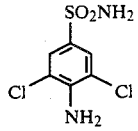

Sensitizing Dye (D-1)

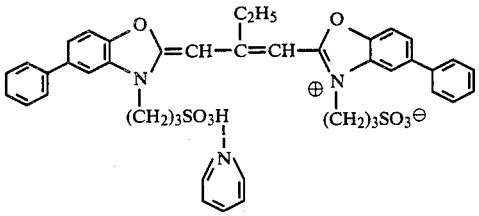

Sensitizing Dye (D-2)

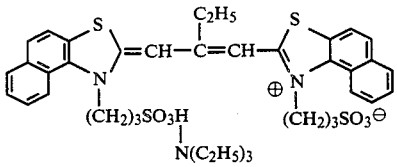

The color sensitive material having the above-described multilayer structure was exposed to light of a tungsten lamp through blue, green and red (BGR) separation filters having continuously altered density for 10 seconds under an illuminance of 2,000 lux.

Thereafter, the material was processed in the same manner as in Example 1, to achieve the results shown below.

| Separation Filter | Heating at 140° C. for 30 sec. Maximum Density | Heating at 140° C. for 30 sec. Minimum Density | Heating at 143° C. for 30 sec. Maximum Density | Heating at 143° C. for 30 sec. Minimum Density |
|---|---|---|---|---|
| B | 1.84 | 0.14 | 1.89 | 0.19 |
| G | 2.10 | 0.19 | 2.14 | 0.24 |
| R | 2.25 | 0.18 | 2.28 | 0.22 |

As can be seen from the results shown above, the compounds of the present invention has proved to have a great effect on compensation for temperature change.

EXAMPLE 4

Another color sensitive material having a multilayer structure was prepared in the manner described below.

Sensitive Material I:

A silver halide emulsion to be employed for the fifth layer was made as follows.

To a vigorously stirred water solution of gelatin (prepared by dissolving 20 g of gelatin and ammonia in 1,000 ml of water, and kept at 5° C.), 1,000 ml of a water solution containing potassium iodide and potassium bromide and a water solution of silver nitrate (in which 1 mole of silver nitrate was dissolved in 1,000 ml of water) were added at the same time as the pAg of the resulting mixture was maintained constant. Thus, a monodisperse octahedral silver iodobromide emulsion (containing 5 mol% of silver iodide) having a mean grain size of 0.5 μm was obtained.

After conclusion of washing and desalting steps, the emulsion was submitted to sulfur and gold sensitizations at 60° C. by adding thereto 5 mg of chloroauric acid (tetrahydrate) and 2 mg of sodium thiosulfate. A yield of the thus obtained emulsion was 1.0 kg.

A silver halide emulsion to be employed for the this layer was made as follows.

To a vigorously stirred water solution of gelatin (prepared by dissolving 20 g of gelatin and 3 g of sodium chloride in 1,000 ml of water, and kept at 75° C.), 600 ml of a water solution containing sodium chloride and potassium bromide and a water solution silver nitrate (prepared by dissolving 0.59 mole of silver nitrate in 600 ml of water) and additionally, a dye solution (I) described hereinafter, were added simultaneously in equal dropping amounts over a 40-minute period. Thus, a dye-adsorbed monodisperse cubic silver chlorobromide emulsion (containing 80 mol% of silver bromide) having a mean grain size of 0.35 μm was obtained.

After conclusion of washing and desalting steps, the emulsion was chemically sensitized at 60° C. by adding thereto 5 mg of sodium thiosulfate and 20 mg of 4-hydroxy-6-methyl-1,3,3a,7-tetraazaindene. The yield of the thus-obtained emulsion was 600 g.

Dye Solution (I)

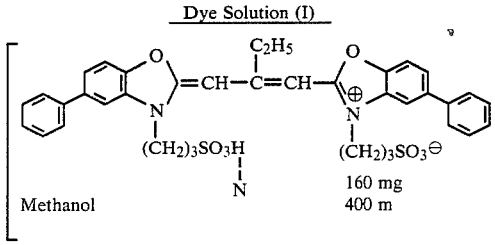

An emulsion to be used for the first layer was made as follows.

To a vigorously stirred water solution of gelatin (prepared by dissolving 20 g of gelatin and 3 g of sodium chloride in 1,000 ml of water, and kept at 75° C.), 600 ml of a water solution containing sodium chloride and potassium bromide and 600 ml of a water solution of silver nitrate (prepared by dissolving 0.59 mole of silver nitrate in 600 ml of water) were added simultaneously in equal dropping amounts over a 40-minute period. Thus, a monodisperse cubic silver chlorobromide emulsion containing 80 mol% of silver bromide) having a mean grain size of 0.35 μm was obtained.

After conclusion of washing and desalting steps, the emulsion was chemically sensitized at 60° C. by adding thereto 5 mg of sodium thiosulfate and 20 mg of 4-hydroxy-6-methyl-1,3,3a,7-tetraazaindene. A yield of the thus obtained emulsion was 600 g.

A benzotriazole silver emulsion was prepared in the same manner as in Example 1.

A color sensitive emulsion material having the multilayer structure consisting of the layers listed in the following table was produced using the above-described emulsions and the compositions described in the following table.

The 6th layer

Layer containing 740 mg/m$^2$ of gelatin and 320 mg/m$^2$ of the base precursor (A)*3.

The 5th layer

Blue-sensitive emulsion layer containing the silver iodobromide emulsion (containing 5 mol% of silver iodide and 500 mg/m$^2$ of silver), 160 mg/m$^2$ of the compound*5 illustrated below, 350 mg/m$^2$ of the base precursor(A)*3, the benzotriazole silver emulsion (containing 300 mg/m$^2$ of silver), 400 mg/m$^2$ of the yellow dye-providing substance (2), 1,200 mg/m$^2$ of gelatin, 700 mg/m$^2$ of the high boiling point solvent*1 and 70 mg/m$^2$ of the surface active agent*2.

The 4th layer

Interlayer containing 700 mg/m$^2$ of gelatin and 310 mg/m$^2$ of the base precursor (A).

The 3rd layer

Green-sensitive emulsion layer containing the silver chlorobromide emulsion (containing 80 mol% of silver bromide and 200 mg/m$^2$ of silver), 140 mg/m$^2$ of the compound*5 illustrated below, the benzotriazole silver emulsion (containing 100 mg/m$^2$ of silver), 270 mg/m$^2$ of the base precursor (A)*3, 330 mg/m$^2$ of the magenta dye-providing substance (1), 860 mg/m$^2$ of gelatin, 430 mg/m$^2$ of the high point solvent*1 and 60 mg/m$^2$ of the surface active agent*2.

The 2nd layer

Interlayer containing 1,000 mg/m$^2$ of gelatin and 310 mg/m$^2$ of the base precursor (A)*3.

The 1st layer

Red-sensitive emulsion layer containing the silver chlorobromide emulsion (containing 80 mol% of silver iodide and 200 mg/m$^2$ of silver), 140 mg/m$^2$ of the compound*5 illustrated below, $8\times10^{-7}$ mol/m$^2$ of sensitizing dye*4, 100 mg/m$^2$ of the benzotriazole silver emulsion, 300 mg/m$^2$ of the base precursor (A)*3, 300 mg/m$^2$ of the cyan dye-providing substance (3), 850 mg/m$^2$ of gelatin, 540 mg/m$^2$ of the high boiling point solvent*1 and 60 mg/m$^2$ of the surface active agent*3.

Support

*1: $(iso\text{-}C_9H_{19}O)_3P{=}O$

*2: $C_9H_{19}$— 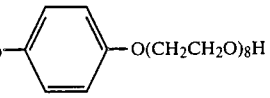 —$O(CH_2CH_2O)_8H$

*3: Base Precursor (A)

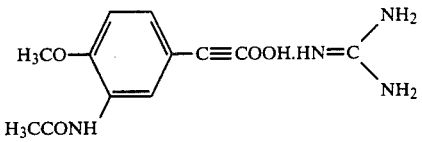

*4: 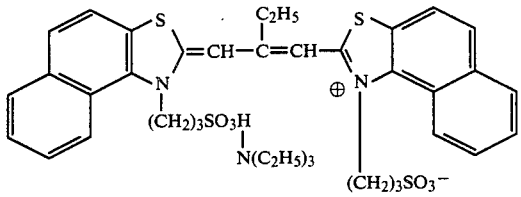

*5: 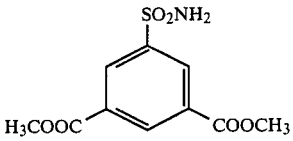

A dye-fixing material was prepared in the manner described below.

12 g of lime-processed gelatin was dissolved in 200 ml of water, and 16 ml of a 0.5M water solution of zinc acetate was added thereto and mixed homogeneously. This mixture was coated uniformly in a wet thickness of 85 μm on a 100 μm-thick white film support formed of titanium dioxide-containing polyethylene terephthalate. Thereon, the coating composition described below was coated uniformly in a wet thickness of 90 μm, and dried. Thus, a dye-fixing material was obtained.

| Formula J of Coating Composition for Dye-Fixing Layer: | |
|---|---|
| 10% Water solution of polyvinyl alcohol (polymerization degree: 2000) | 120 g |
| Urea | 20 g |
| N—methyl urea | 20 g |
| 12% Water solution of $(CH_2{-}CH)$ 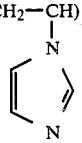 | 80 g |
| Compound (6) of Present Invention (described in Example 1) | 60 ml |

| Formula K of Coating Composition for Dye-Fixing Layer: | |
|---|---|
| 10% Water solution of polyvinyl alcohol (polymerization degree: 2000) | 120 g |
| Urea | 20 g |
| N—methyl urea | 20 g |
| 12% Aqueous solution of $\leftarrow CH_2{-}CH \rightarrow$ 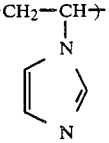 | 80 g |
| Water | 60 ml |

The color sensitive material I having the above-described multilayer structure was exposed to light of a tungsten lamp through Blue, Green, and Red separation filters having continuously altered density for 1 second under illuminance of 2,000 lux. Thereafter, the material was heated uniformly on a hot block kept at 140° C. for 30 seconds.

The processed color sensitive material and the dye-fixing material were superposed on each other in such a condition that the coated sides of both materials were in face-to-face contact, and then passed between a pair of heat- and pressure-applying rolls kept at 130° C. Immediately after the passage, the materials were heated on a hot block kept at 120° C. for 30 seconds. As soon as the heating was concluded, the dye-fixing material was peeled off the sensitive material. Thereupon, yellow, magenta, and cyan color images were obtained on the dye-fixing material corresponding to Blue, Green and Red separation filters, respectively.

The maximum density and the minimum density of each color were measured using a Macbeth reflection densitometer (RD-519). The results obtained are shown in the following table.

| | Formula J (Invention) | | Formula K (Comparison) | |
|---|---|---|---|---|
| Separation Filter | Maximum Density | Minimum Density | Maximum Density | Minimum Density |
| B | 1.80 | 0.20 | 1.82 | 0.29 |
| G | 2.04 | 0.18 | 2.06 | 0.28 |
| R | 2.19 | 0.18 | 2.21 | 0.25 |

As can be seen from the results shown above, an increase of fog during the transfer step was depressed by the addition of the compound of the present invention to the dye-fixing layer.

EXAMPLE 5

10 g of the dye-providing substance (4) having the structure formula illustrated hereinafter, 0.5 g of 2-ethylhexyl sodium sulfosuccinate, and 10 g of tricresyl phosphate were weighed, and admixed with 20 ml of cyclohexanone. This admixture was heated to about 60° C. to convert it into homogeneous solution. This solution was mixed with 100 g of a 10% water solution of lime-processed gelatin with stirring, and emulsified to form a dispersion using a homogenizer.

A sensitive material L was prepared by combining the following components.

| | | |
|---|---|---|
| (a) | Silver iodobromide emulsion prepared in Example 1 | 5.5 g |
| (b) | 10% Water solution of gelatin | 0.5 g |
| (c) | Above-described dispersion of dye-providing substance | 2.5 g |
| (d) | 10% Ethanol solution of guanidine trichloroacetate | 1 ml |
| (e) | 10% Methanol solution of 2,6-dichloro-4-aminophenol | 0.5 ml |
| (f) | 5% Water solution of compound illustrated below: | 1 ml |

-continued

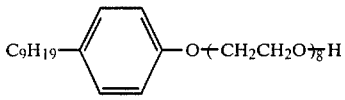

| | | |
|---|---|---|
| (g) | Gelatin dispersion of Compound (6) of the present invention | 0.5 ml |
| (h) | Water | 6 ml |

Dye-providing Substance (4)

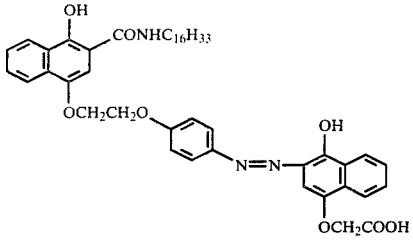

The above-described ingredients (a) to (h) were mixed, and dissolved by heating to prepare a coating composition. The composition was coated on a polyethylene terephthalate film in a wet thickness of 85 μm. On this coat, gelatin was coated at a coverage of 1.5 g/m$^2$ as protective layer. Thus, the sensitive material L was obtained.

The sensitive material L was exposed and processed in the same manner as in Example 1. Density measurements of this material gave the results shown below.

| | Heating at 140° C. for 30 seconds | | Heating at 143° C. for 30 seconds | |
|---|---|---|---|---|
| | Maximum Density | Minimum Density | Maximum Density | Minimum Density |
| L | 1.95 | 0.17 | 2.01 | 0.21 |

It can be read from the above-described result that the compound of the present invention produced a great effect in the sensitive material containing a dye-providing substance of the kind which releases a dye through the coupling reaction with the oxidation product of a developing agent, also.

EXAMPLE 6

To a mixture of 5 g of the dye-providing substance (5) having the structural formula illustrated below, 4 g of the electron donor having the structural formula illustrated below, 0.5 g of 2-ethylhexyl sodium sulfosuccinate and 10 g of tricresyl phosphate, 20 ml of cyclohexane was added, and heated at about 60° C. to dissolve the mixture therein. Subsequent steps for preparation of the dispersion of the dye-providing substance (5), which is susceptible to reduction, were the same as in Example 5.

Dye-providing Substance (5):

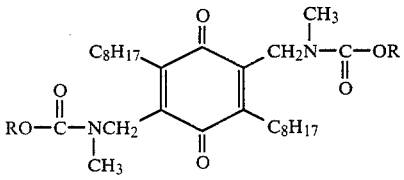

Herein, R represents

-continued

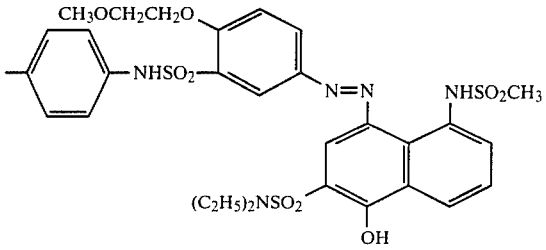

Electron donator

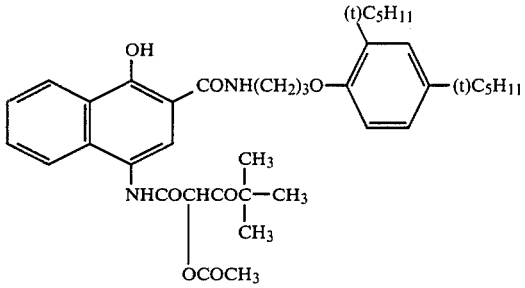

A sensitive material M was produced in the same manner as the sensitive material L in Example 5, except that the above-described dispersion of the reduction susceptible dye-providing substance was employed in place of the dispersion of the dye-providing substance (4).

The sensitive material M was exposed and processed in the same manner as in Example 1. Density measurement of this material gave the results shown below.

| | Heating at 140° C. for 30 seconds | | Heating at 143° C. for 30 seconds | |
|---|---|---|---|---|
| | Maximum Density | Minimum Density | Maximum Density | Minimum Density |
| M | 1.62 | 0.16 | 1.69 | 0.19 |

The effectiveness of the compound of the present invention was also confirmed by the results shown above in the sensitive material containing the above-described reduction susceptible dye-providing substance, which can produce an image that is positive with respect to the silver image.

EXAMPLE 7

A gelatin dispersion of a coupler was prepared as follows.

5 g of 2-dodecylcarbamoyl-1-naphthol, 0.5 g of 2-ethylhexyl sodium sulfosuccinate and 2.5 g of tricresyl phosphate (TCP) were weighed out, respectively. To the mixture of thse ingredients was added 30 ml of ethyl acetate to prepare a solution. The solution was mixed with 100 g of a 10% gelatin solution with stirring, and further dispersed thereinto using a homogenizer rotating at 10,000 rpm for 10 minutes.

A sensitive material N was produced in the manner described below.

| | | |
|---|---|---|
| (a) | Silver iodobromide emulsion (prepared in Example 1) | 10 g |
| (b) | Gelatin dispersion of coupler | 3.5 g |
| (c) | Solution prepared by dissolving | |

-continued

| | | |
|---|---|---|
| | 0.25 g of guanidine trichloroacetate in 2.5 ml of ethanol | |
| (d) | Gelatin (10% water solution) | 5 g |
| (e) | Solution containing 0.2 g of 2,6-dichloro-p-aminophenol in 15 ml of water | |
| (f) | Gelatin dispersion of Compound (6) of the present invention (described in Example 1) | 1 ml |

The above-described ingredients (a) to (f) were mixed to prepare a coating composition. The coating composition was coated on a polyethylene terephthalate support in a wet thickness of 60 μm, and dried to produce the desired sensitive material N.

The sensitive material N was exposed imagewise for 5 seconds under illuminance of 2000 lux using a tungsten lamp. Thereafter, the material was heated uniformly for 20 seconds on a hot block kept at 150° C. or 153° C. Thereupon, negative cyan color image was obtained. Densities of this image were measured using a Macbeth transmission densitometer (TD-504), and the results shown below were obtained.

| | Heating at 150° C. for 20 seconds | | Heating at 153° C. for 20 seconds | |
|---|---|---|---|---|
| | Maximum Density | Minimum Density | Maximum Density | Minimum Density |
| N | 2.02 | 0.20 | 2.07 | 0.24 |

As can be seen from the results shown above, the compound of the present invention had a great effect on compensation for temperature change.

EXAMPLE 8

The black-and-white sensitive material O was produced in the manner described below.

| | | |
|---|---|---|
| (a) | Silver iodobromide emulsion (described in Example 1) | 1 g |
| (b) | Benzotriazole silver emulsion (described in Example 1) | 10 g |
| (c) | 10% Ethanol solution of guanidine trichloroacetate | 1 ml |
| (d) | 5% Methanol solution of Compound represented by following structural formula | 2 ml |

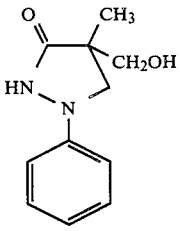

| | | |
|---|---|---|
| (e) | Gelatin dispersion of Compound (6) of the present invention (described in Example 1) | 1 ml |

The mixture of the above-described ingredients (a) to (e) was coated on a polyethylene terephthalate support in a wet thickness of 60 μm, and dried.

The thus produced material was exposed imagewise for 5 seconds under illuminance of 2000 lux using a tungsten lamp. Thereafter, the material was heated uniformly for 30 seconds on a hot block kept at 130° C. to 133° C. Thereupon, a negative brown image was obtained. Density measurements of this image using a MacBeth transmission-type densitometer (TD-504) gave the following results.

| | Heating at 130° C. for 30 seconds | | Heating at 133° C. for 30 seconds | |
|---|---|---|---|---|
| Sensitive Material | Maximum Density | Minimum Density | Maximum Density | Minimum Density |
| 0 | 0.78 | 0.12 | 0.82 | 0.15 |

As can be seen from the results shown above, the compound of the present invention had also a great effect on compensation for temperature change in a black-and-white sensitive material.

While the invention has been described in detail and with reference to specific embodiments thereof, it will be apparent to one skilled in the art that various changes and modifications can be made therein without departing from the spirit and scope thereof.

What is claimed is:

1. A method for forming an image, comprising imagewise exposing an image-forming material comprising a light-sensitive silver halide layer and heating the image-forming material in the presence of a compound represented by formula (I) and a nucleophilic agent and/or a base:

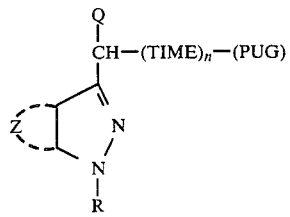

(I)

wherein R represents a hydrogen atom, or a group selected from a class consisting of groups represented by formulae (A) to (C)

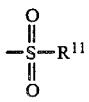

(A)

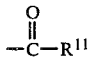

(B)

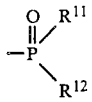

(C)

wherein $R^{11}$ and $R^{12}$ each represents a substituted or unsubstituted alkyl group, a cyloalkyl group, a substituted or unsubstituted alkenyl group, an aralkyl group, a substituted or unsubstituted aryl group, a heterocyclic group, an alkyloxy group, an aryloxy group, an alkylthio group, an arylthio group, or a substituted or unsubstituted amino group, or $R^{11}$ and $R^{12}$ combine with each other to form a 5- or 6-membered ring; Q represents a hydrogen atom, an alkyl group, or an aryl group; TIME represents a timing group; PUG represents a photographically useful agent moiety; n represents 0 or an integer; and Z represents atoms forming a benzene ring.

2. A method for forming an image as in claim 1, wherein at least one of $R^{11}$ and $R^{12}$ represents straight or branched chain alkyl group containing from 1 to 18 carbon atoms.

3. A method for forming an image as in claim 1, wherein at least one of $R^{11}$ and $R^{12}$ represents a 5- or 6-membered cycloalkyl group containing from 5 to 10 carbon atoms.

4. A method for forming an image as in claim 1, wherein at least one of $R^{11}$ and $R^{12}$ represents an alkenyl group.

5. A method for forming an image as in claim 1, wherein at least one of $R^{11}$ and $R^{12}$ represents an aralkyl group.

6. A method for forming an image as in claim 1, wherein at least one of $R^{11}$ and $R^{12}$ represents an aryl group containing from 6 to 18 carbon atoms.

7. A method for forming an image as in claim 1, wherein at least one of $R^{11}$ and $R^{12}$ represents a 5-or 6-membered heterocyclic ring containing oxygen, nitrogen, or sulfur as a hetero atom.

8. A method for forming an image as in claim 1, wherein at least one of $R^{11}$ and $R^{12}$ represents an alkyloxy or an aryloxy group represented by formula (D)

$$-OR^{13} \qquad \text{(D)}$$

wherein $R^{13}$ represents a substituted or unsubstituted alkyl group or substituted or unsubstituted aryl group.

9. A method for forming an image as in claim 1, wherein at least one of $R^{11}$ and $R^{12}$ represents an alkylthio or arylthio group represented by formula (E)

$$-SR^{14} \qquad \text{(E)}$$

wherein $R^{14}$ represents a substituted or unsubstituted alkyl group or substituted or unsubstituted aryl group.

10. A method for forming an image as in claim 1, wherein the step of heating is carried out at a temperature ranging from 80° C. to 250° C.

11. A method for forming an image as in claim 1, wherein —(PUG) is a development inhibitor-releasing group.

12. A method for forming an image as in claim 11, wherein the development inhibitor released by the development inhibitor-releasing group is represented by formula (II)

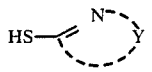

(II)

wherein Y represents atoms forming a 5- or 6-membered heterocyclic ring.

13. A method for forming an image as in claim 12, wherein, in addition to the nitrogen atom N illustrated in formula (II), said heterocyclic ring contains a sulfur atom, an oxygen atom, or another nitrogen atom.

14. A method for forming an image as in claim 11, wherein said compound according to formula (I) is used in combination with a precursor of a base.

15. A method for forming an image as in claim 14, wherein the molar ratio of the base precursor to the compound represented by formula (I) ranges from 1/20 to 20/1.

16. A method for forming an image as in claim 14, wherein the molar ratio of the base precursor to the compound represented by formula (I) ranges from 1/5 to 5/1.

* * * * *